US007481744B2

(12) United States Patent
Reyes et al.

(10) Patent No.: US 7,481,744 B2
(45) Date of Patent: Jan. 27, 2009

(54) CONTROL CIRCUIT USING TOGGLED ACTIVATION TO REDUCE INRUSH CURRENTS

(75) Inventors: Javier J. Reyes, Fullerton, CA (US); Gregory A. Wallace, Mission Viejo, CA (US)

(73) Assignee: Unisen, Inc., Irvine, CA (US)

( * ) Notice: Subject to any disclaimer, the term of this patent is extended or adjusted under 35 U.S.C. 154(b) by 15 days.

(21) Appl. No.: 11/500,582

(22) Filed: Aug. 8, 2006

(65) Prior Publication Data

US 2007/0032351 A1 Feb. 8, 2007

Related U.S. Application Data

(62) Division of application No. 10/299,648, filed on Nov. 19, 2002, now Pat. No. 7,086,995.

(60) Provisional application No. 60/399,336, filed on Jul. 26, 2002.

(51) Int. Cl.
*A63B 22/02* (2006.01)

(52) U.S. Cl. ..... 482/54; 482/1; 482/8; 482/900

(58) Field of Classification Search ..... 482/1–9, 482/51, 52, 54, 57, 62, 72, 73, 900–902; 434/247, 253; 310/62; 363/141; 318/471, 318/782, 772

See application file for complete search history.

(56) References Cited

U.S. PATENT DOCUMENTS 2,262,376 A * 11/1941 Veinott ..... 318/772
2,319,490 A * 5/1943 Clark ..... 318/782
4,039,467 A 8/1977 Tucker
4,537,396 A * 8/1985 Hooper ..... 482/8
5,049,079 A * 9/1991 Furtado et al. ..... 434/253
5,210,477 A * 5/1993 Rowlette et al. ..... 318/471
5,831,847 A * 11/1998 Love ..... 363/141
5,897,460 A 4/1999 McBride et al.
6,300,694 B1 * 10/2001 Wang et al. ..... 310/62
6,450,923 B1 * 9/2002 Vatti ..... 482/8
6,496,874 B1 12/2002 Janky et al.

(Continued)

FOREIGN PATENT DOCUMENTS

DE 202 17 832 U1 1/2004

(Continued)

OTHER PUBLICATIONS

European Search Report, App. No. 04 025 862.6, Date: Sep. 13, 2005, 2 pages.

(Continued)

*Primary Examiner*—Glenn Richman
(74) *Attorney, Agent, or Firm*—Knobbe, Martens, Olson & Bear, LLP

(57) ABSTRACT

Aspects of the present invention include a controller circuit for an exercise machine, where the controller circuit includes a board mounted transformer having tolerances near or below the inrush current generally present in activating one or more cooling fans. According to one embodiment, the controller circuit attempts to power on a subsequent fan after the sum of the inrush or steady state current of presently operating fan or fans, and the inrush current generally associated with powering on the subsequent fan, is within the tolerances of the transformer.

13 Claims, 23 Drawing Sheets

U.S. PATENT DOCUMENTS

| | | | |
|---|---|---|---|
| 6,509,715 | B1 | 1/2003 | LaRue |
| 6,702,719 | B1 | 3/2004 | Brown et al. |
| 6,745,943 | B2 | 6/2004 | Schlieffers et al. |
| 7,054,148 | B2 | 5/2006 | Chen et al. |
| 7,128,692 | B2 | 10/2006 | Black |
| 7,171,378 | B2 | 1/2007 | Petrovich et al. |
| 7,189,191 | B2 | 3/2007 | Dugan |
| 2002/0091796 | A1 | 7/2002 | Higginson et al. |
| 2003/0225939 | A1 | 12/2003 | Ying et al. |
| 2004/0090350 | A1 | 5/2004 | Yang |
| 2004/0092367 | A1 | 5/2004 | Corbalis et al. |

FOREIGN PATENT DOCUMENTS

| | | |
|---|---|---|
| DE | 20 2004 007 725 U1 | 11/2004 |
| WO | WO 00/69525 | 11/2000 |

OTHER PUBLICATIONS

KIP Machines, KR 320 Sales Presentation Brochure, 1 page.

Star Trac, Press Release: "*A favorable breeze*," The Orange County Register, Business Monday, Jun. 17, 2002, 4 pages.

Tectrix Fitness Equipment, VR Bike, www.tectrix.com/products/VRBike/VR_Bike.html, 2 pages downloaded and printed from the World Wide Web.

Office Action dated May 4, 2007 from Related Application No. 10/698,236.

* cited by examiner

CONTROL CIRCUIT USING TOGGLED ACTIVATION TO REDUCE INRUSH CURRENTS

REFERENCE TO RELATED APPLICATION

The present application is a divisional of U.S. patent application Ser. No. 10/299,648, filed Nov. 19, 2002, now U.S. Pat. No. 7,086,995 entitled "Control Circuit Using Toggled Activation to Reduce Inrush Currents," which claims priority benefit under 35 U.S.C. § 119(e) of U.S. Provisional Application No. 60/399,336, filed Jul. 26, 2002, entitled "Cooling System for Exercise Machine." The present application incorporates the foregoing disclosures herein by reference.

The present application is also related to U.S. patent application Ser. No. 10/299,627, filed Nov. 19, 2002, entitled "Cooling System for Exercise Machine," and U.S. patent application Ser. No. 10/299,625, filed Nov. 19, 2002, entitled "Maintenance Facilitating Exercise Machine Console," the disclosures of which are hereby incorporated by reference in their entirety.

BACKGROUND OF THE INVENTION

1. Field of the Invention

The present invention relates to the field of electronic circuits. More specifically, the invention relates to circuits which reduce the effect of inrush currents.

2. Description of Related Art

When an electric motor is first activated, the drive circuit supplying power thereto often exhibits initial currents, called inrush currents, that can be orders of magnitude greater than the circuit's steady state currents. Even though the inrush currents account for only a very small percentage of a circuit's operating time, circuit designers often use components designed for applications at or even above the inrush currents to ensure the circuit will not fail during activation.

However, it is often advantageous in certain applications to design circuits to use lower power components. For example, board-mounted transformers provide designers the ability to reduce circuit complexity, avoid/meet governmental regulations, more easily dissipate heat, and significantly reduce costs and complexities. The drawback to board-mounted transformers, however, is that they can be rated to power specifications lower than specific applications require.

Accordingly, circuit designers often must choose between using circuit components that are not rated for certain inrush levels, thereby potentially underpowering and/or overloading the desired circuit, or using circuit components that add significant cost and complexity to a particular design. In some applications, such as applications having significantly limited power and/or limited cost margins, use of the costly and complex circuit components can defeat the application at the design stage. For example, in the design of exercise equipment, certain desirable features may have significant cost and design limitations, such as, for example, personal cooling systems including air flow mechanisms like fans. When the design of such mechanisms use components rated to account for inrush currents, the added cost and complexity can dictate their removal from the design.

SUMMARY OF THE INVENTION

Accordingly, embodiments of the present invention include a controller circuit for one or more electric devices, which comprises one or more electronic components having tolerances near or below the inrush current generally present in powering on the electric devices. According to one embodiment, the controller circuit attempts to power on a subsequent electric device after the sum of the inrush or steady state current of presently operating electric devices, and the inrush current generally associated with powering on the subsequent electric device, is within the tolerances of the one or more electronic components.

For example, the controller circuit can be part of a personal cooling system of an exercise machine, such as a treadmill. In such an example, the controller circuit can comprise a fan controller board, the electric devices may include one or more fans, and the electronic components may include a board-mounted transformer having tolerances near or below the inrush current generally present in powering on the fans of the personal cooling system. Some of the purposes for using the foregoing transformer include ensuring a more straightforward and modular design, reducing costs, and ensuring the fan controller board meets regulations for use in residential exercise machines.

In an embodiment, the fan controller board controls the inrush current through the circuit by controlling the power to the fans. For example, the controller board may power on each fan separately, starting a subsequent fan after knowing that the sum of an inrush or steady state current of one or more currently powered fans, and the inrush current associated with powering on the subsequent fan, is within the tolerances of the transformer.

According to an embodiment, the fan controller board can include a modular design and on-board diagnostics for more straightforward maintenance, can include a voltage key for selectability in the power source, and can include a fan speed indicator for providing information on fan speed to the a user of the exercise equipment.

For purposes of summarizing the invention, certain aspects, advantages and novel features of the invention have been described herein. Of course, it is to be understood that not necessarily all such aspects, advantages or features will be embodied in any particular embodiment of the invention.

BRIEF DESCRIPTION OF THE DRAWINGS

These and other features, aspects and advantages of the present invention will now be described with reference to the drawings. The drawings and the associated descriptions are provided to illustrate embodiments of the present invention and not to limit the scope of the invention. Throughout the drawings, reference numbers will be consistently used to indicate corresponding elements in different figures. In addition, the first digit of each reference number may indicate the figure in which the element first appears, particularly in the latter portion of the disclosure.

DETAILED DESCRIPTION OF THE PREFERRED EMBODIMENTS

Figure 1:
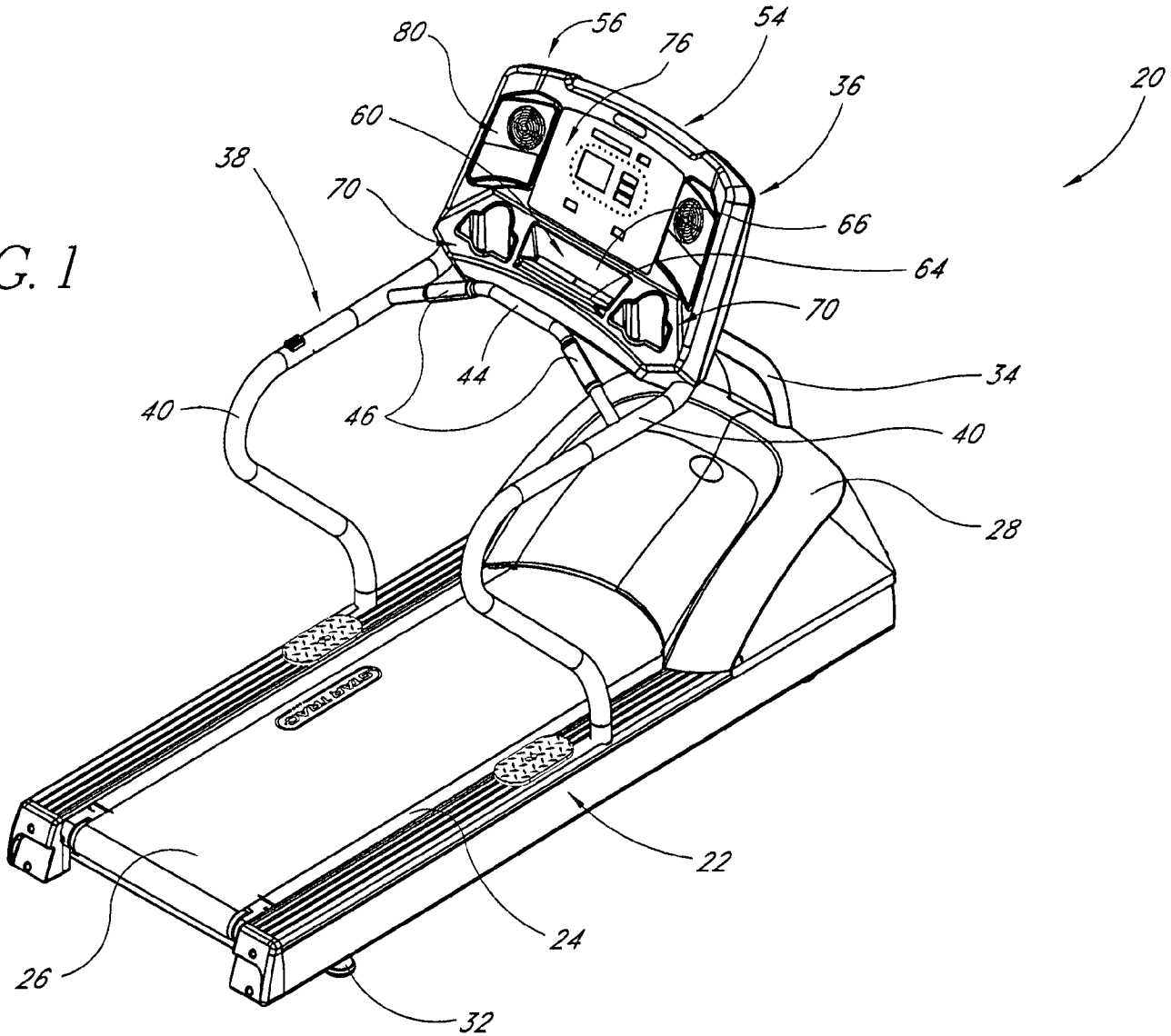
FIG. 1 is a perspective view of a treadmill taken from the upper, rear, right side, which is arranged and configured in accordance with certain features, aspects and advantages of the present invention.

With reference now to FIGS. 1-6, a treadmill 20 that is arranged and configured in accordance with certain features, aspects and advantages of the present invention is illustrated therein. While various features of the present invention have been shown and will be described in the context of the treadmill 20, the present invention also can be used with other forms of exercise apparatus, such as, but not limited to, stair climbers, elliptical exercise machines, stationary bicycles, ski machines and the like.

The treadmill 20 generally comprises a frame assembly 22. The frame assembly 22 can have any suitable configuration. In one arrangement, the frame assembly 22 is formed by a number of tubular members that are secured together by, for instance, welding, brackets and/or fasteners. The frame assembly 22 generally defines a base structure of the treadmill 20.

A support surface 24 is connected to the frame assembly 22. The support surface 24 can be secured to the frame assembly 22 in any suitable manner. The support surface generally defines a planar surface upon which a user is supported when mounting the treadmill 20, when dismounting the treadmill 20 and when exercising on the treadmill 20.

An endless belt 26 extends over the support surface 24. The endless belt 26 is tensioned and driven by a belt drive assembly (not shown). Any suitable belt drive assembly can be used. The belt drive assembly preferably is a motor driven assembly, which comprises a motor 29 (shown schematically in FIG. 3 connected to a shaft 27 driving the belt 26). In some applications, however, the belt drive assembly is not actually driving the belt, but may be turning a generator based upon movement of the belt, which is imparted by the user. In the illustrated arrangement, a motor housing 28 is disposed over a forward portion of the endless belt 26. The motor housing 28 advantageously comprises a contoured surface that faces the user such that the user is less likely to kick the motor housing 28 during use.

The frame assembly 22 can be supported in any suitable manner relative to a floor or other surface. In the illustrated arrangement, the frame assembly 22 is supported by a pair of rollers 30 at a forward end and by a pair of leveling feet 32 at a rearward end. The illustrated arrangement advantageously results in the rollers 30 being placed beneath a majority of the machine weight. In other arrangements, any number of leveling feet or rollers can be used. In yet other arrangements, the frame assembly 22 itself can be constructed with integral components that are supported by the floor or other surface.

In the illustrated arrangement, a support standard 34 extends upward and rearward from a forward side of the motor housing 28. The illustrated standard 34 is connected to the frame assembly 22 at a forward side with treaded fasteners. Other connections also can be used. The standard 34 extends to a console 36 in the illustrated arrangement. As such, in the illustrated arrangement, the standard 34 extends upward and bends rearward to place the console 36 at a location generally rearward of the motor housing 28.

Advantageously, the illustrated standard 34 is a hollow member. Forming the standard 34 of a hollow tubular member decreases the overall weight of the treadmill 20. In addition, the hollow standard 34 can act as a wiring conduit such that wires can pass through the standard 34 between the console 36 and the motor housing 28. In another arrangement, the hollow standard 34 can be used as an air conduit to provide airflow to either the console 36 or to a user of the treadmill 20.

As illustrated in FIG. 1, a railing assembly 38 extends upward and forward from a portion of the frame assembly 22. The railing assembly 38 preferably is connected to a portion of the console 36 and can be connected to the console 36 in a manner that will be described in further detail below.

Figure 6:
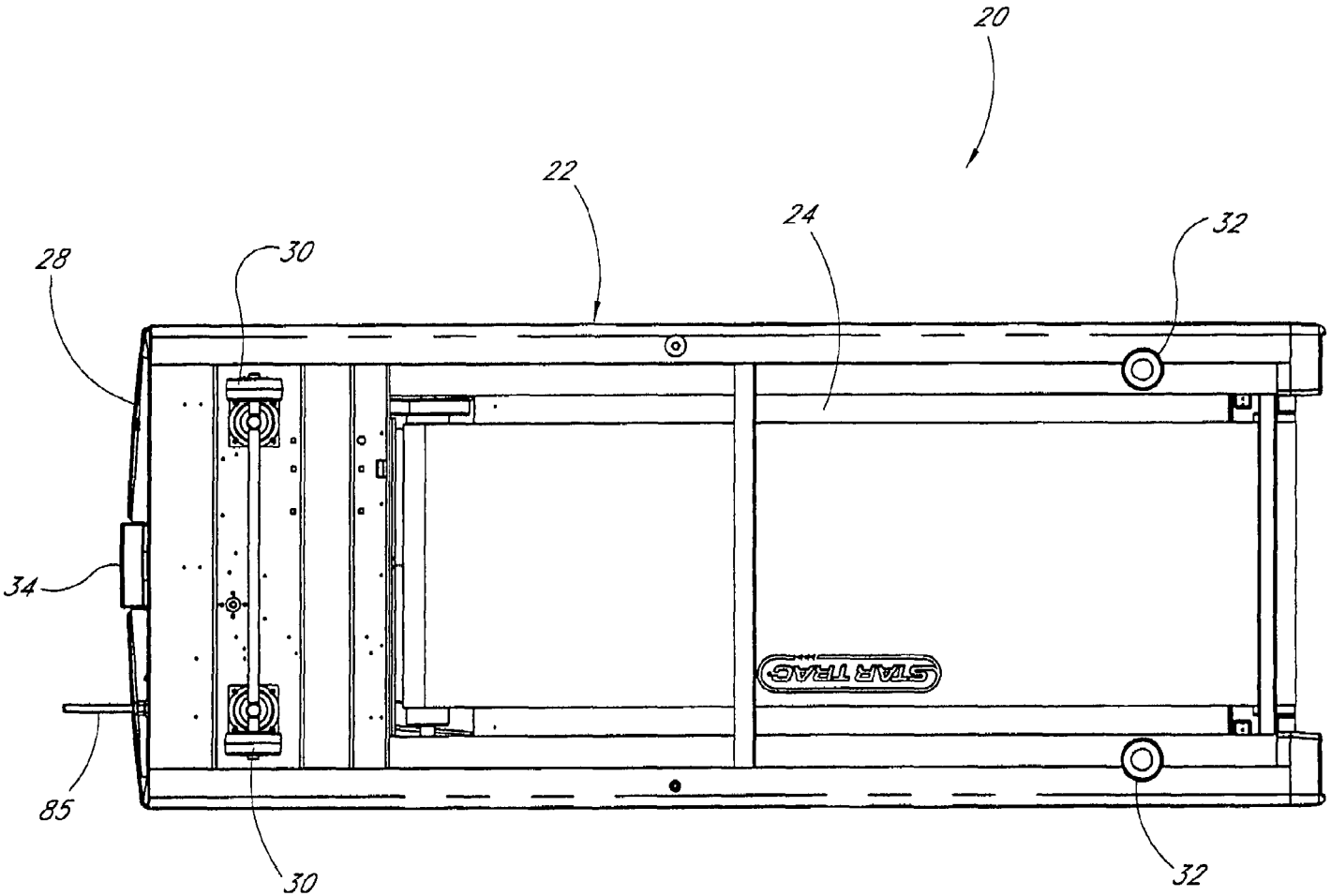
FIG. 6 is a bottom plan view of the treadmill of FIG. 1.
Figure 7:
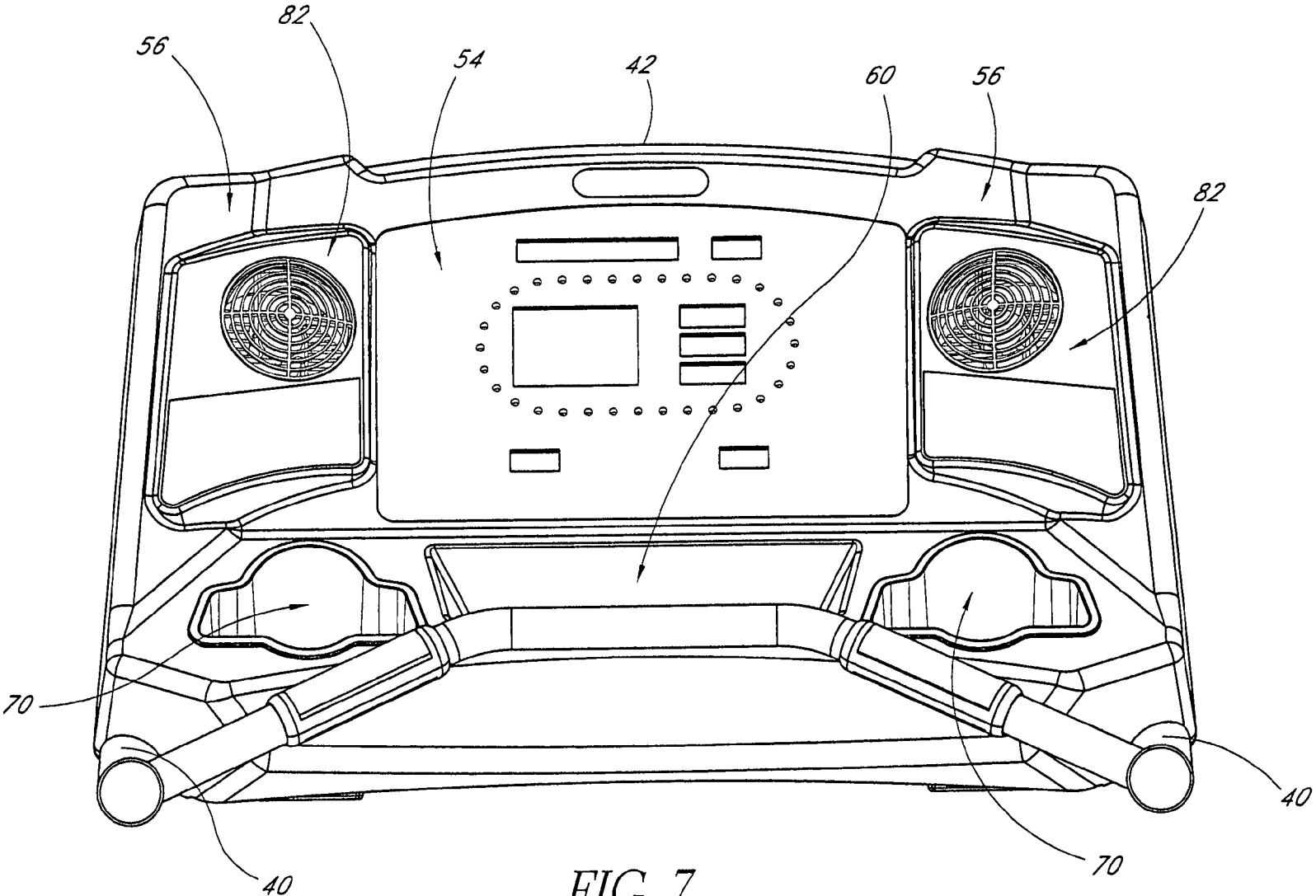
FIG. 7 is a user side view of a display console used with a treadmill, such as the treadmill illustrated in FIGS. 1-6, and arranged and configured in accordance with certain features, aspects and advantages of the present invention.
Figure 8:
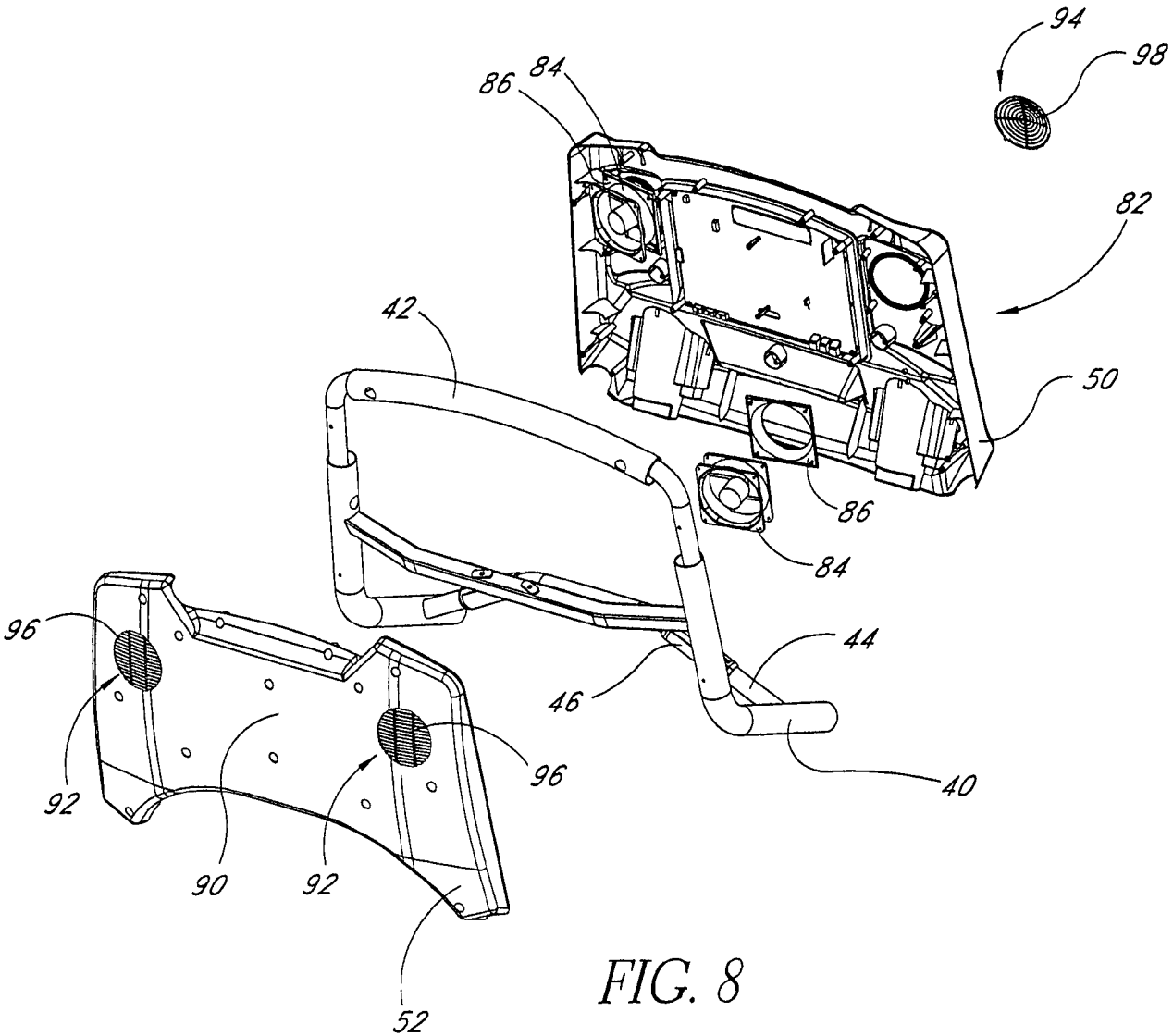
FIG. 8 is an exploded view of the display console showing a user cooling assembly that is integrated into the display console, which is arranged and configured in accordance with certain features, aspects and advantages of the present invention.

With reference now to FIG. 6, the railing assembly 38 preferably comprises a pair of handrails 40 (one shown) that extend upward from the frame assembly 22. The handrails 40 can be constructed of any number of components, depending upon the application. In addition, the illustrated handrails 40 extend slightly away from the console 38 while extending upward before turning toward the console 38. Such a construction allows greater breadth in the region commonly used during exercise.

The illustrated handrails 40 preferably are connected at a forward end by a cross-member 42. The cross member 42 can be integrally formed with the handrails 40 in some arrangements. The cross member 42 is exposed at an upper portion of the console 36 in the illustrated arrangement. As such, the cross member 42 defines a grab bar that can be gripped by a user during operation of the treadmill or during data input prior to using the treadmill, for instance. Preferably, this cross member 42 is disposed at about shoulder level or slightly below shoulder level for about 95 percent of the male population. In some arrangements, the cross member 42 can be disposed at about shoulder level or slightly below shoulder level for about 95 percent of the female population. Other heights also can be used depending upon the target user population.

The illustrated railing assembly 38 also comprises at least one handgrip 44 that extends inward from the handrails 40. Preferably, the handgrip 44 extends between the handrails 40 at a location between the user and the console 38. In some arrangements, the handgrip 44 can comprise sensors 46 to detect user pulse rates and the like. The illustrated handgrip 44 is positioned such that a user can easily grasp the handgrip 44 during operation of the treadmill. In one arrangement, the handgrip is at or above the waist level for about 95 percent of the female population. In another arrangement, the handgrip can be at or above the waist level for about 95 percent of the male population. Other heights can be used and the handgrip could be adjustable in height in some applications.

Figure 2:
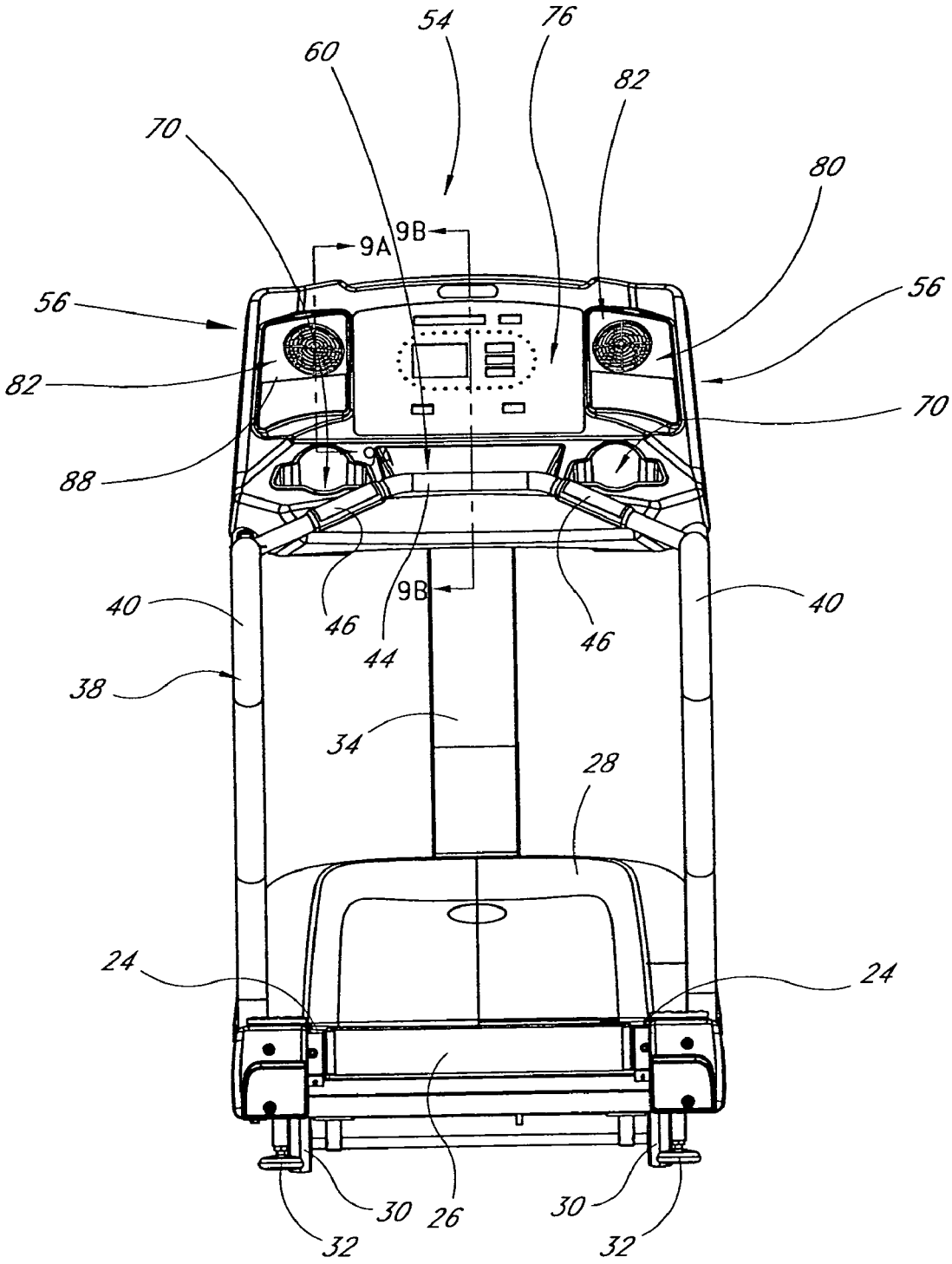
FIG. 2 is a rear elevation view of the treadmill of FIG. 1.
Figure 3:
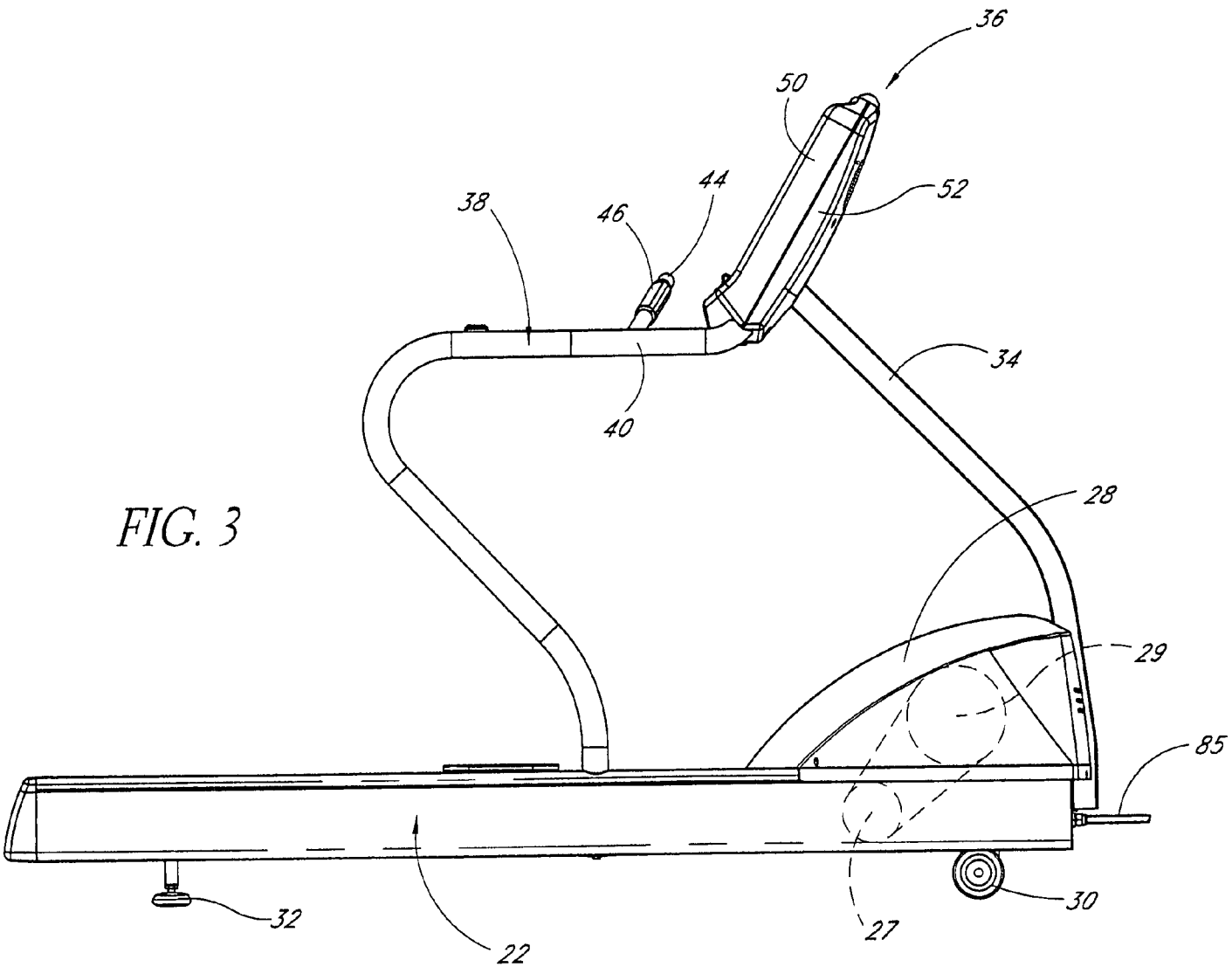
FIG. 3 is a right side elevation view of the treadmill of FIG. 1, which is substantially a mirror image of the left side elevation view.
Figure 4:
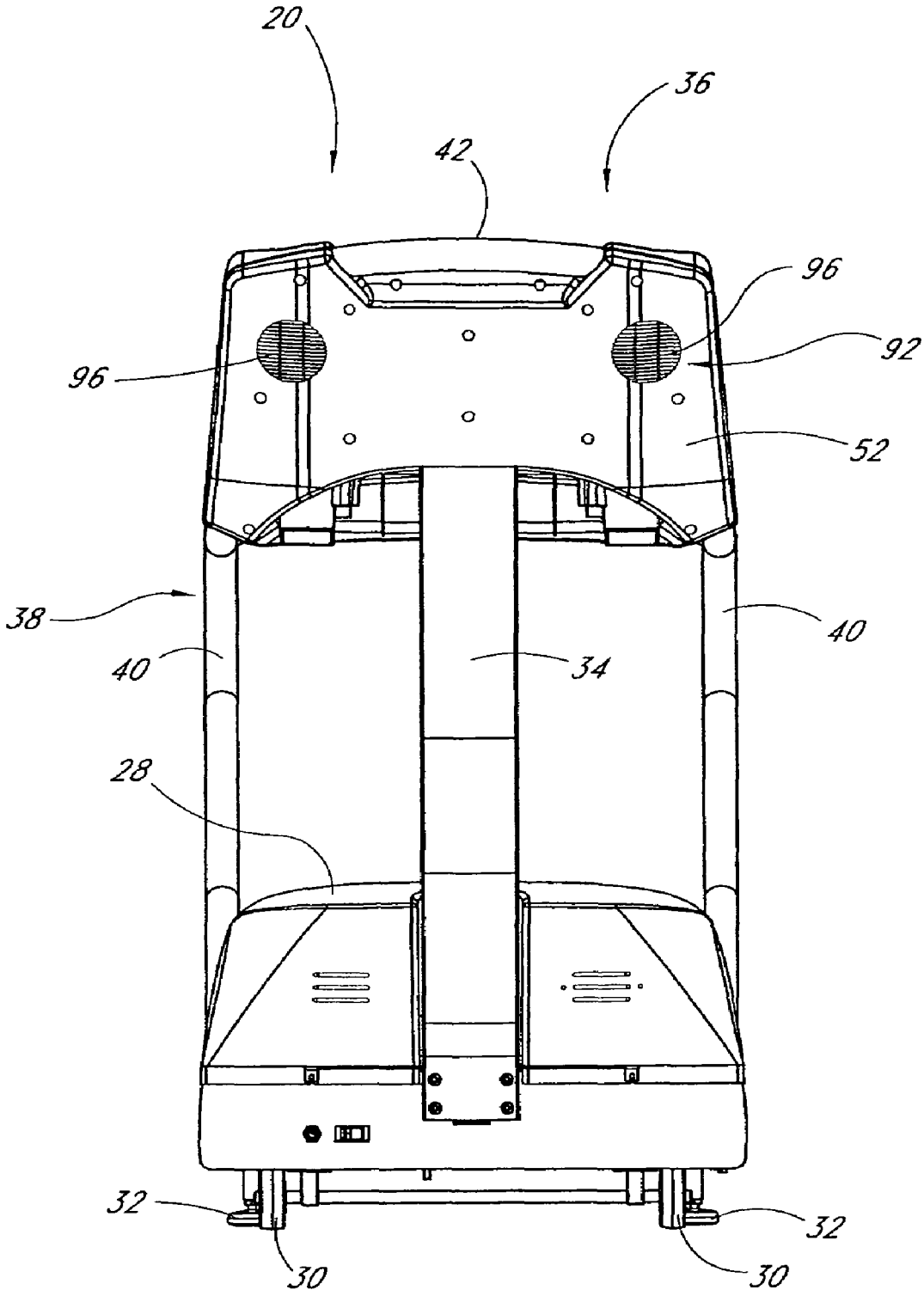
FIG. 4 is a front elevation view of the treadmill of FIG. 1.

With reference now to FIGS. 2 and 6, the console 36 will be described in greater detail. In general, the console 36 preferably is formed of a group of suitable plastic moldings. In the illustrated arrangement, an outer shell of the console 36 generally comprises a front piece 50 and a rear piece 52. While additional outer pieces can be used, reducing the number of pieces in the illustrated arrangement advantageously reduces manufacturing costs.

The two pieces 50, 52 can be attached together in any suitable manner. To ease disassembly for maintenance and the like, the two pieces 50, 52 preferably are attached using removable fasteners or mechanical interlocking components. Any such attachment arrangements can be used.

Moreover, in the illustrated arrangement, the console 36 is advantageously connected to the railing assembly 38 by capturing a portion of the railing assembly 38 between the two pieces 50, 52. More specifically, the illustrated cross member 42 is captured between the two pieces 50, 52 within a channel defined by pegs, fastener anchors or the like. Such an arrangement increases the support for the display while reducing the number of pieces used in assembling the exercise machine. Hence manufacturing and maintenance costs can be reduced.

In the illustrated arrangement, the console 36 preferably is slightly concave on the face directed toward the user. As such, the console 36 advantageously comprises a center section 54 and a pair of side wing portions 56 with the center section 54 being recessed away from the user. The side wing portions 56 are provided on separate sides of a generally longitudinally extending center plane CP. The side wings 56 preferably are angled relative to the center section 54 such that an included angle of between about 5° and about 25° is defined between the center section 54 and the side wings 56. In one arrangement, the included angle is between about 10° and about 15°. In a particularly preferred arrangement, the included angle is about 10°.

In addition, the illustrated console face is angled relative to a generally vertical transverse plane V in the illustrated arrangement. In one arrangement, this angle is between about 15° and about 45°. In another arrangement, this angle is between about 20° and about 40°. In one particularly advantageous arrangement, this angle is about 30°. In some arrangements, the console 36 generally is disposed between the waist level of about 95 percent of the female population and the head level of about 95 percent of the male population. Other heights also can be used depending upon the application.

With reference now to FIG. 1, the console 36 also comprises an elongated accessory holder 60. In the illustrated arrangement, the accessory holder 60 is integrally formed with the center section 54. The accessory holder 60 preferably comprises a recessed pocket that is sized as desired. In one arrangement, the accessory holder 60 has a length such that a book or magazine can be easily held within the accessory holder 60. Accordingly, in such an arrangement, the accessory holder 60 can have a length between about 8" and about 14". In one preferred arrangement, the accessory holder has a length of about 9.7". Preferably, the accessory holder 60 has a slightly angled front lip 62 relative to a rear wall 64 of the accessory holder 60.

Figure 5:
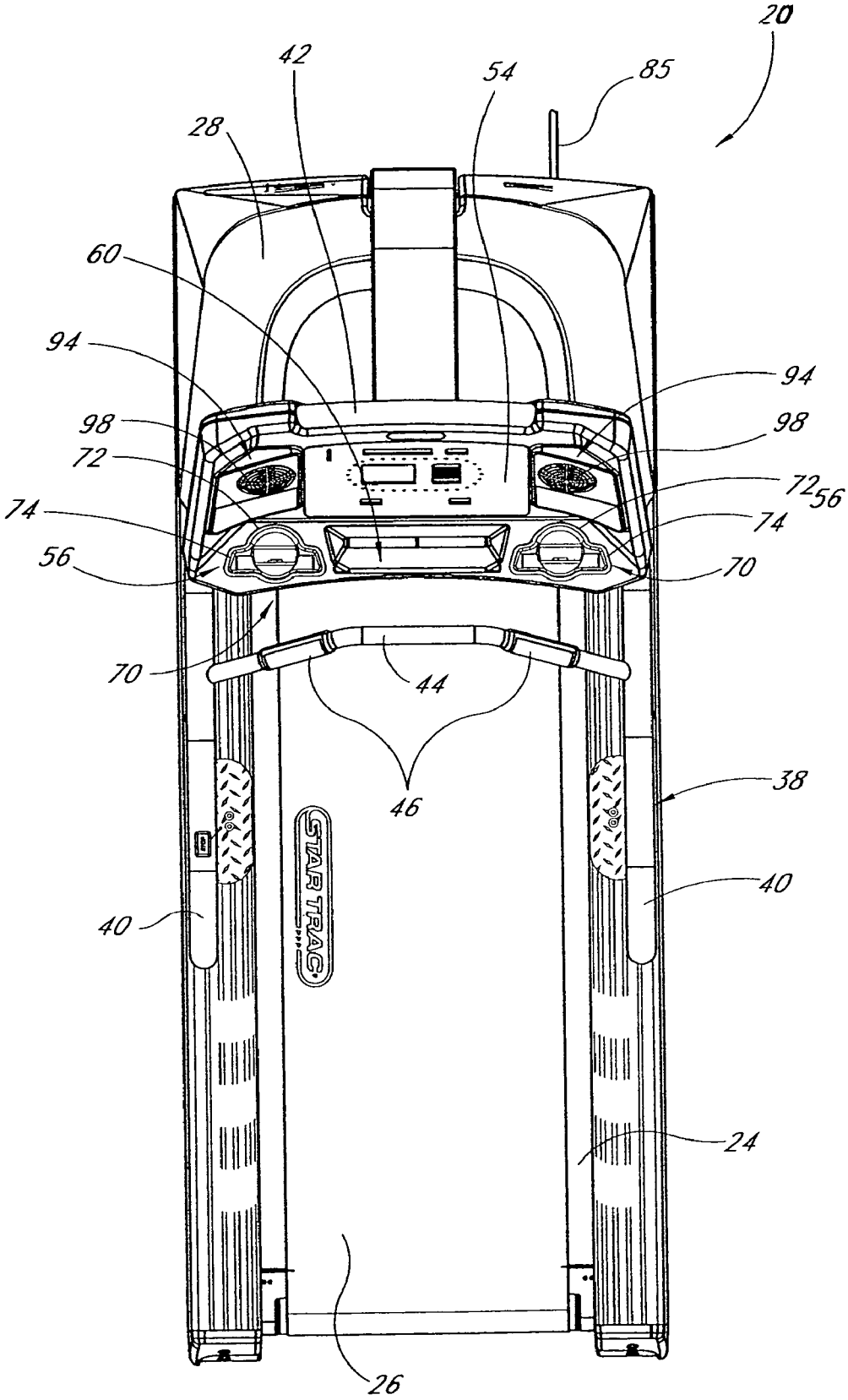
FIG. 5 is a top plan view of the treadmill of FIG. 1.

With continued reference to FIG. 1 and with additional reference to FIG. 5, a pair of smaller accessory holders 70 are disposed to the sides of the accessory holder 60. The smaller accessory holders 70 preferably are positioned on the side wings 56. In one arrangement, the smaller accessory holders 70 are shaped to accept a variety of items having differing cross-sectional profiles. For instance, with references to FIG. 5, the accessory holders 70 comprise a rounded generally cylindrical portion 72 and a slot portion 74 that intersect. As such, the illustrated accessory holders 70 can accept rounded articles (e.g., cans, bottles, etc.) and more square articles (e.g., personal data assistants, wallets, cellular telephones, etc.). In one particularly preferred arrangement, data transfer ports and power ports can be provided in the accessory holders 60, 70 such that a personal data assistant, cellular phone or the like can be plugged into the data port, allowing for transfer of data between the personal data assistant and a control unit of the exercise machine or other electronic component (e.g., to provide streaming audio, video, interactive information or the like) or to allowing charging of such electrical devices.

It should be noted that while the adjective smaller is used with respect to the illustrated accessory holders 70, this term should not suggest that these accessory holders 70 must be smaller than another accessory holder. Any relative sizing of the accessory holders can be used as desired.

The illustrated console 36 preferably also comprises one or more information display arrangements 76. The information display arrangements 76 can take any suitable configuration. For instance, in some arrangements, the information display arrangement 76 can include light bars (e.g., LED lamps in a line). In other arrangements, the information display arrangement 76 can include a display screen (e.g., a liquid crystal panel or the like). The information display arrangement can be used to form a portion of a user interface. The user interface allows a user to input information and to receive information. Many such interfaces are well known.

With reference now to FIG. 2, the illustrated treadmill 20 advantageously comprises an integrated user cooling system 80. The cooling system 80 comprises at least one fan assembly 82 that is mounted to the treadmill at a location above the base structure of the treadmill (e.g., at the console 36). By positioning the fan assembly 82 at a location above the base structure of the treadmill, the fan assembly 82 is closer to the head and upper body region of a user. Such a location decreases the flow rate of air that needs to be achieved in order for adequate cooling to be achieved.

In the illustrated arrangement, two fan assemblies 82 are provided, with one fan assembly 82 being mounted in each of the side wing portions 56. As described above, the illustrated console 36 is advantageously angled such that the height and the angles result in a straight airflow vector AF toward a user's upper body and/or head region. Other consoles designs (e.g., differing heights and/or angles) can be used and the fans can be angled relative to the console accordingly. The illustrated arrangement, however, has been designed for a unique appearance while maintaining a suitable relationship between the fans and the user.

The fan assembly 82 generally comprises a blower or fan 84 that preferably is electrically connected to a power source of the exercise machine through a controller circuit as disclosed with reference to FIGS. 12-16. Alternatively, the fan 84 can be connected to a power supply that is fed by a power cord 85 used to supply power to the control system or motor of the treadmill. In other arrangements, if the treadmill 20 comprises a generator, the fan 84 can be driven by electrical power supplied by the generator. Such electrical connections reduce the number of plugs that must be accommodated by a gym or home for use of the machine.

Figure 9B:
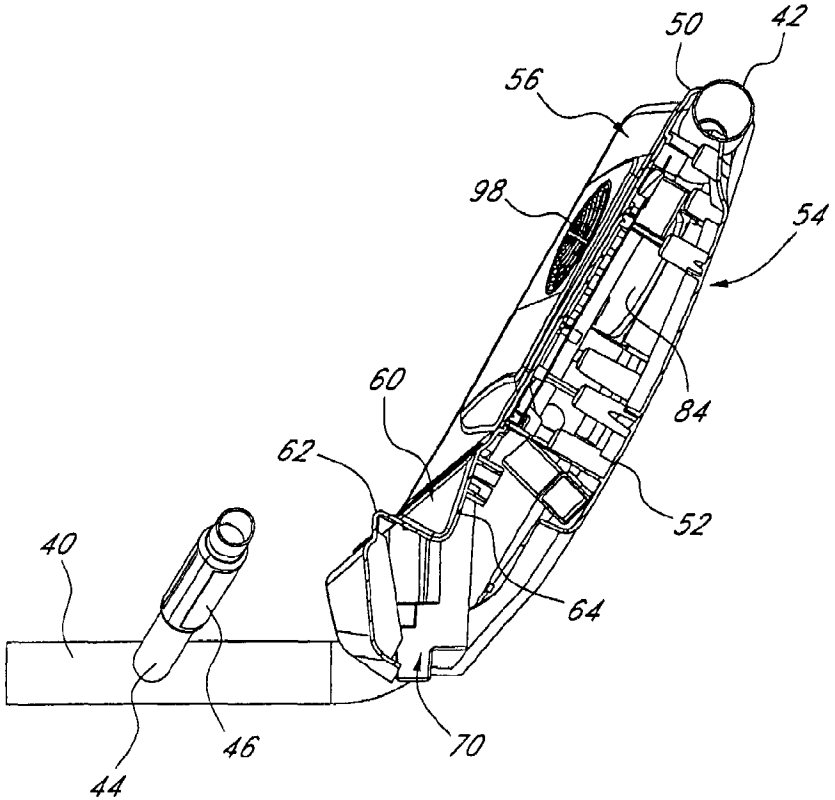
FIG. 9B is a section view generally taken along the line B-B in FIG. 7.
Figure 9A:
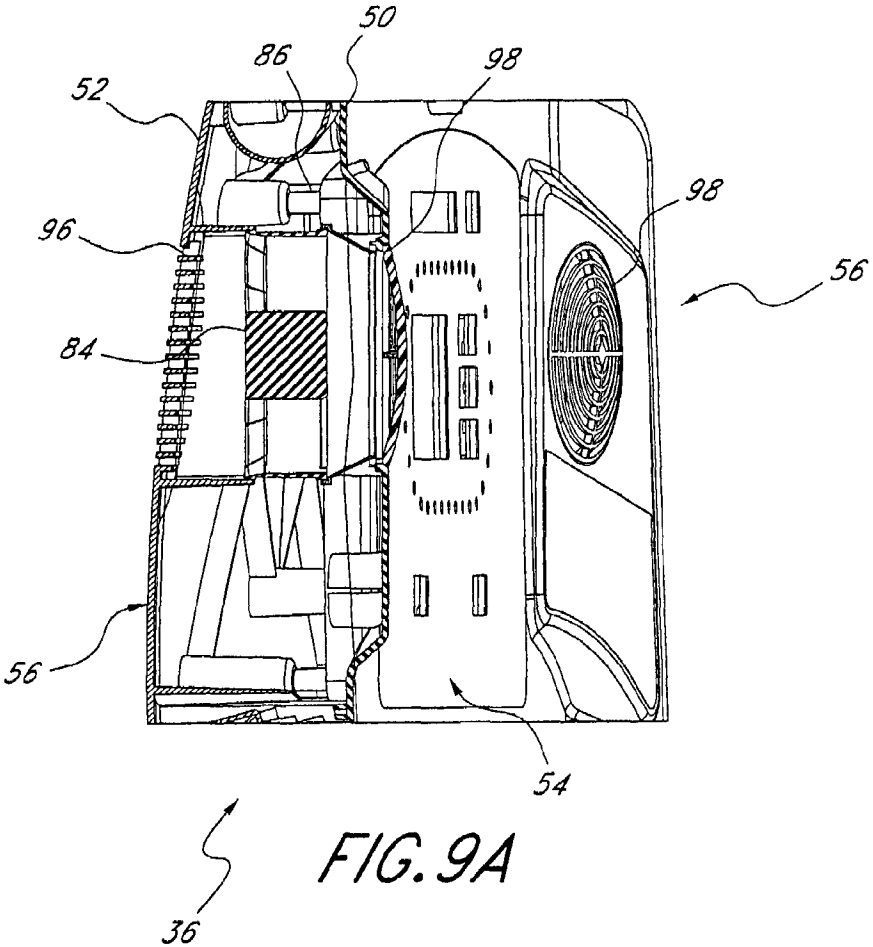
FIG. 9A is a section view generally taken along the line A-A in FIG. 7.

The fan 84 can be any suitable type of fan (e.g., tube axial fan, centrifugal fan, vane axial fan). In the illustrated arrangement, a tube axial fan is used. With reference to FIG. 9A, the fan 84 preferably is encased within the console 36. More preferably, the fan 84 is positioned within ducting 86 in a manner that reduces or eliminates airflow through a cavity defined within the console 36 outside of the ducting 86. In the illustrated arrangement, the ducting 86 comprises a rubber duct section 87 and the housing of the tube axial fan. In this arrangement, a portion of the ducting 86 also comprises a portion 89 of one of the pieces 50, 52 of the outer shell of the console. Other suitable ducting arrangements can be used. Advantageously, the fan 84 is disposed between a portion of the rear piece 52 of the console 36 and the ducting 86 and the two components can be used to support the fan 84 such that assembly and maintenance can be simplified. In one alternative arrangement, the fan 84 and the ducting 86 can be unitarily formed such that fewer components are used in the construction of the cooling system 80.

The ducting 86 advantageously extends between a user surface 88 of the console 36 (i.e., a surface that faces the user during operation) and another surface that does not face the user during operation. In one advantageous arrangement, the ducting 86 extends straight through the console 36 between the user surface 88 and a back surface 90. In another arrangement, the ducting 86 is bent such that the ducting 86 extends between the user surface and a side surface of the console 36. Preferably, an inlet to the fan assembly 82 and an outlet to the fan assembly are positioned to reduce recirculation of air from the outlet to the inlet. In the illustrated arrangement, such a recirculating restriction is achieved by positioning the inlet 92 on the back surface 90 and the outlet 94 on the user surface 88.

Preferably, both the inlet 92 and the outlet 94 are covered by respective grills 96, 98. In some arrangements, the outlet 94 can be covered by a flow directing assembly or component, such as louvers or the like. By properly angling the surfaces of the console 36 about the outlet 94, the angling of the airflow is simply achieved. In some arrangements, a nozzle or gimbal arrangement can be used to further enhance directional control. In the illustrated arrangement, the angle of the ducting and the restriction defined by the ducting 86 are used to direct a focused stream of air toward an upper portion of a user's body when positioned for use on the illustrated treadmill.

Figure 10:
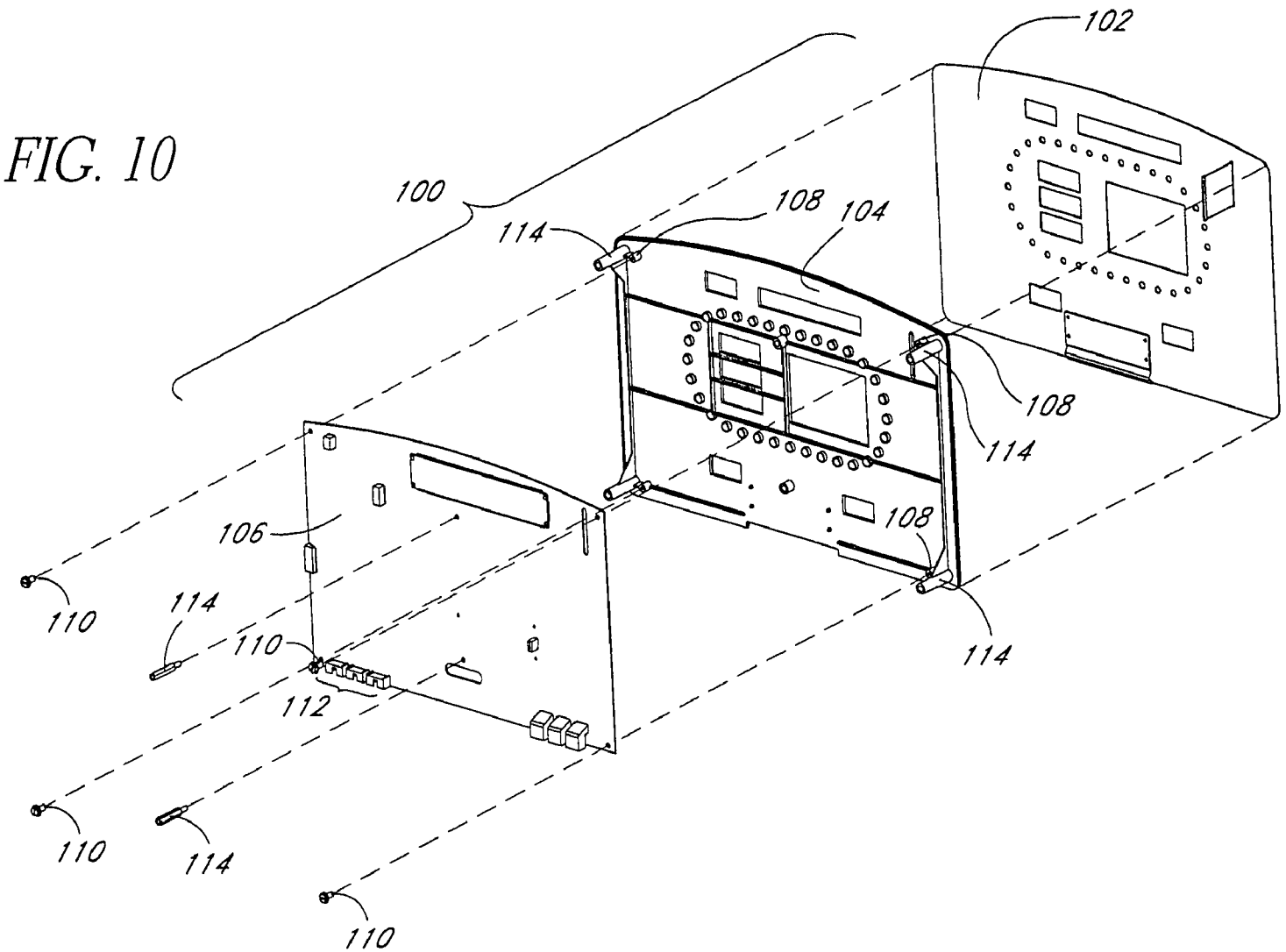
FIG. 10 is an exploded view showing a display electronics assembly used with the display console of FIG. 7, which assembly is arranged and configured in accordance with certain features, aspects and advantages of the present invention.
Figure 11:
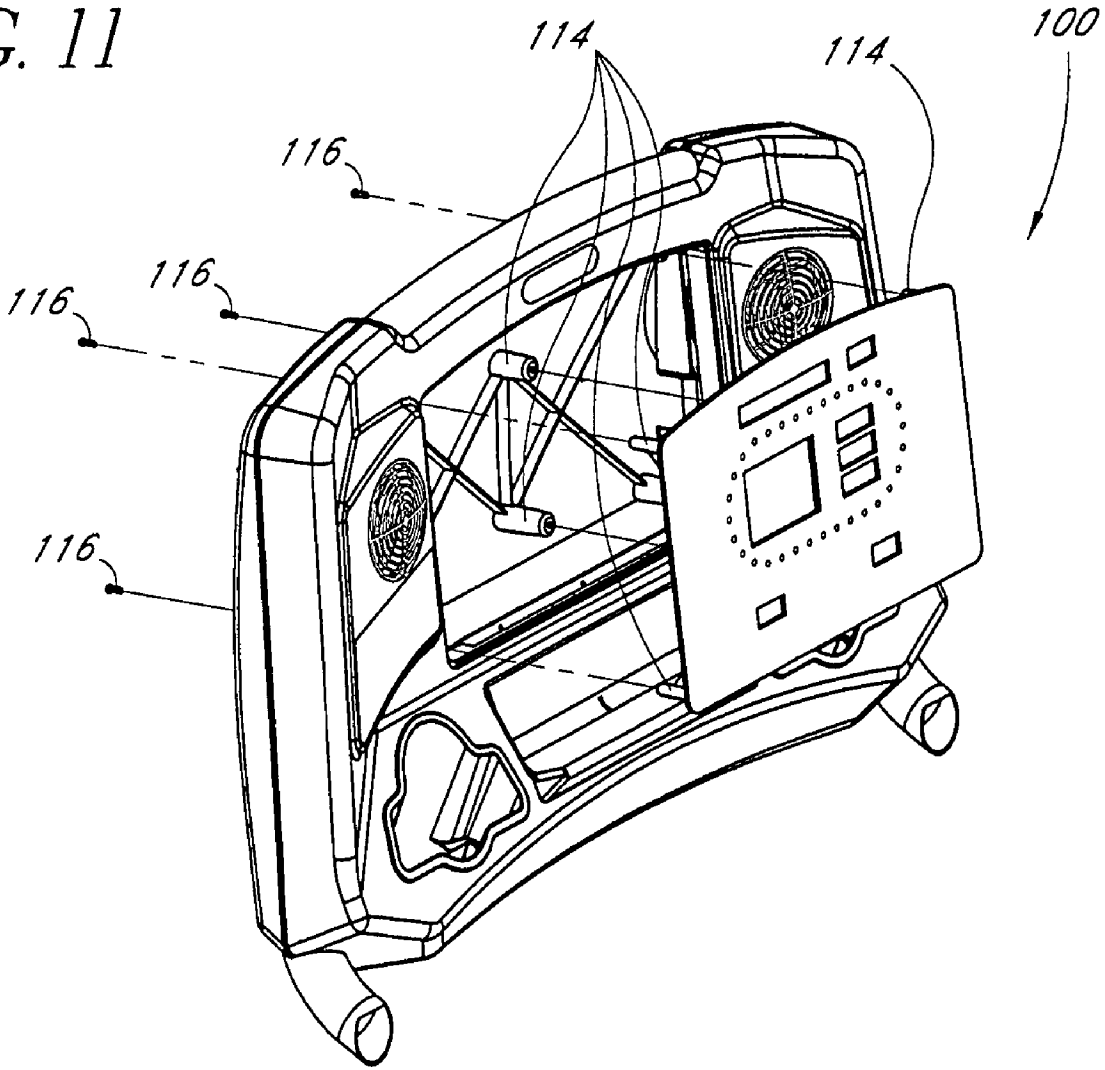
FIG. 11 is an exploded view showing a mounting arrangement used to secure the display electronics assembly of FIG. 10 to the display console of FIG. 7, which arrangement comprises certain features, aspects and advantages of the present invention.

With reference now to FIGS. 10 and 11, a display electronics assembly 100 is illustrated in simplified form. This assembly 100 is one presently preferred construction of at least a portion of the display arrangement 76. The illustrated display electronics assembly 100 generally comprises a keypad panel 102, a display panel 104 and an electronics panel 106. The three panels 102, 104, 106 are placed together in a suitable manner. In the illustrated arrangement, the keypad panel 102 and the display panel 104 generally abut each other while the display panel 104 is offset from the electronics panel 106 by standoffs 108. Such an arrangement facilitates cooling of the electronics panel 106. Threaded fasteners 110 or other suitable connection mechanisms can be used to secure the panels 102-106 together.

The electronics panel 106 preferably comprises connectors used to supply power and used to transfer information between the display electronics assembly 100 and a controller of the treadmill 20. Suitable electrical conduits (e.g., wires and connectors) can be used to place the electronics panel 106 in electrical communication with the controller. In some arrangements, infrared or other arrangements (e.g., not hard-wired connections) can be used.

Advantageously, the display electronics assembly 100 can be fitted to and removed from the console 38 by simply removing a fastening assembly and unplugging any wires that connect the display electronics assembly 100 to the controller. In the illustrated arrangement, the display electronics assembly 100 is secured in position using standoffs 114 and threaded fasteners 116. Other mechanical connection arrangements can be used. The illustrated arrangement, however, advantageously simplifies replacement of a faulty display assembly 100 and eases maintenance.

With reference now to FIGS. 12-16, a control circuit 1202, such as, for example, a fan controller board 1300, which is arranged and configured in accordance with certain features, aspects and advantages of the present invention is illustrated therein. While various features of the present invention have been shown and will be described in the context of the control circuit 1202 for use with the foregoing treadmill 20, the present invention also can be used with other forms of exercise apparatus, such as, but not limited to, stair climbers, elliptical exercise machines, stationary bicycles, ski machines and the like.

Figure 12B:
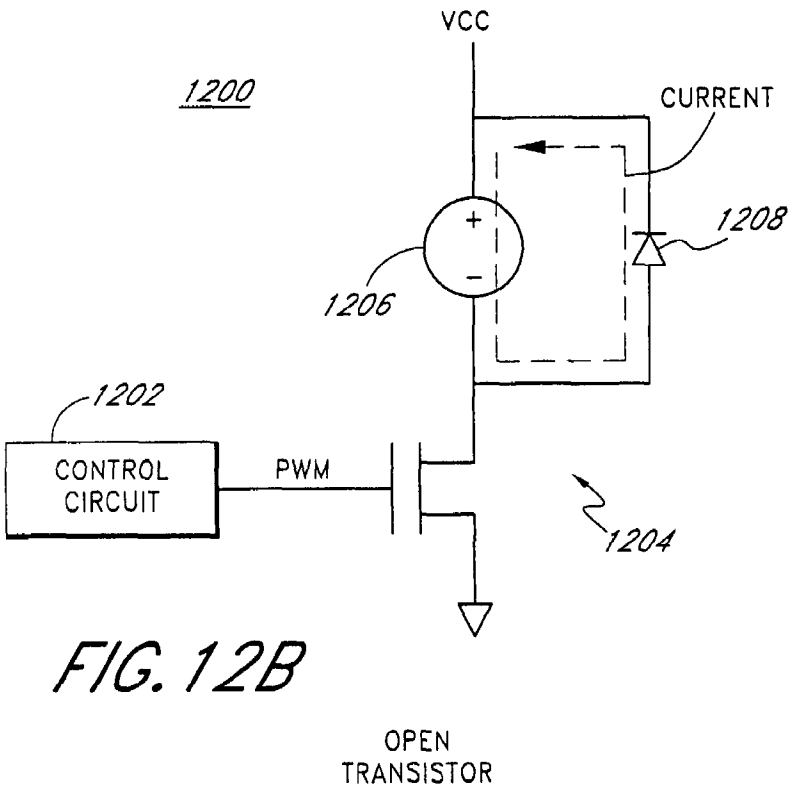
FIG. 12 is a simplified circuit diagram illustrating the use of pulse width modulation to control an electric motor in accordance with certain features, aspects and advantages of the present invention.
Figure 12A:
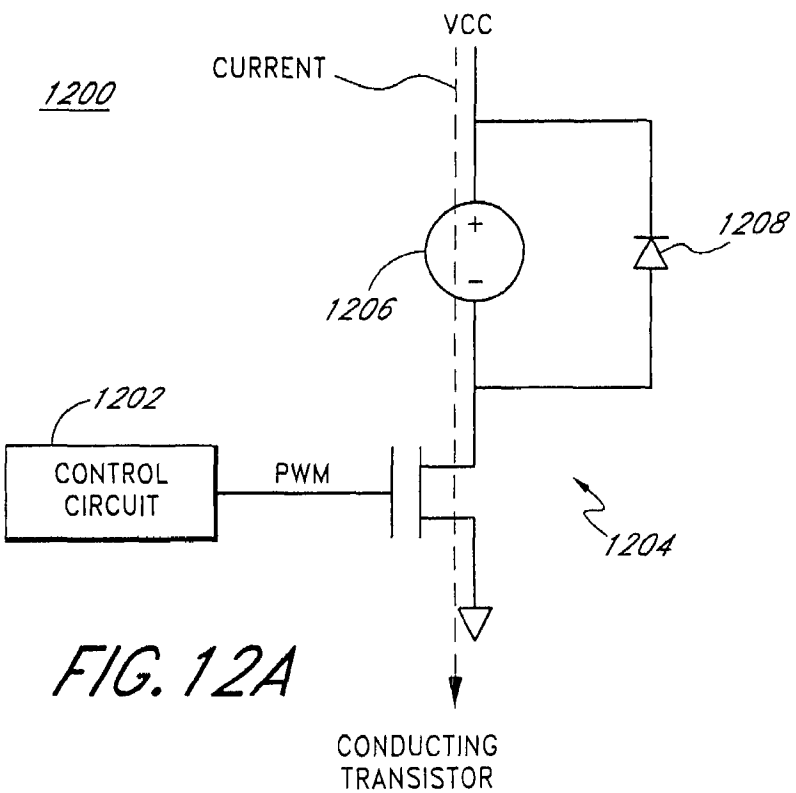

FIGS. 12A-12B illustrate a simplified circuit diagram 1200 comprising a control circuit 1202, a transistor 1204, an electric motor 1206, and a flyback diode 1208. As shown in FIGS. 12A-12B, the control circuit 1202 outputs a pulse width modulated (PWM) drive signal to switch the transistor 1204 on and off (conducting and open), thereby effectively toggling the activation of current through the circuit. The control circuit 1202 turns on the current by switching the transistor 1204 to a conducting circuit for a brief instant, defined by the duty cycle of the PWM drive signal, as shown in FIG. 12A. Each instant can be less that the time it takes for the current through the motor to reach its peak inrush current, then the controller circuit 1202 shuts the current off by switching the transistor 1204 to an open circuit. Since the motor 1206 cannot stop instantaneously, the flyback diode 1208 allows the current to keep flowing, as shown in FIG. 12B. Before the current dissipates, the next pulse turns current back on and gives the motor 1206 another boost. The more the current is conducting, or the greater the duty cycle of the PWM drive signal, the more energy the motor 1206 receives and the faster it turns. Accordingly, through the use of the PWM drive signal, the control circuit 1202 effectively and efficiently controls the inrush current as well as the steady state speed of the fan.

Figure 13:
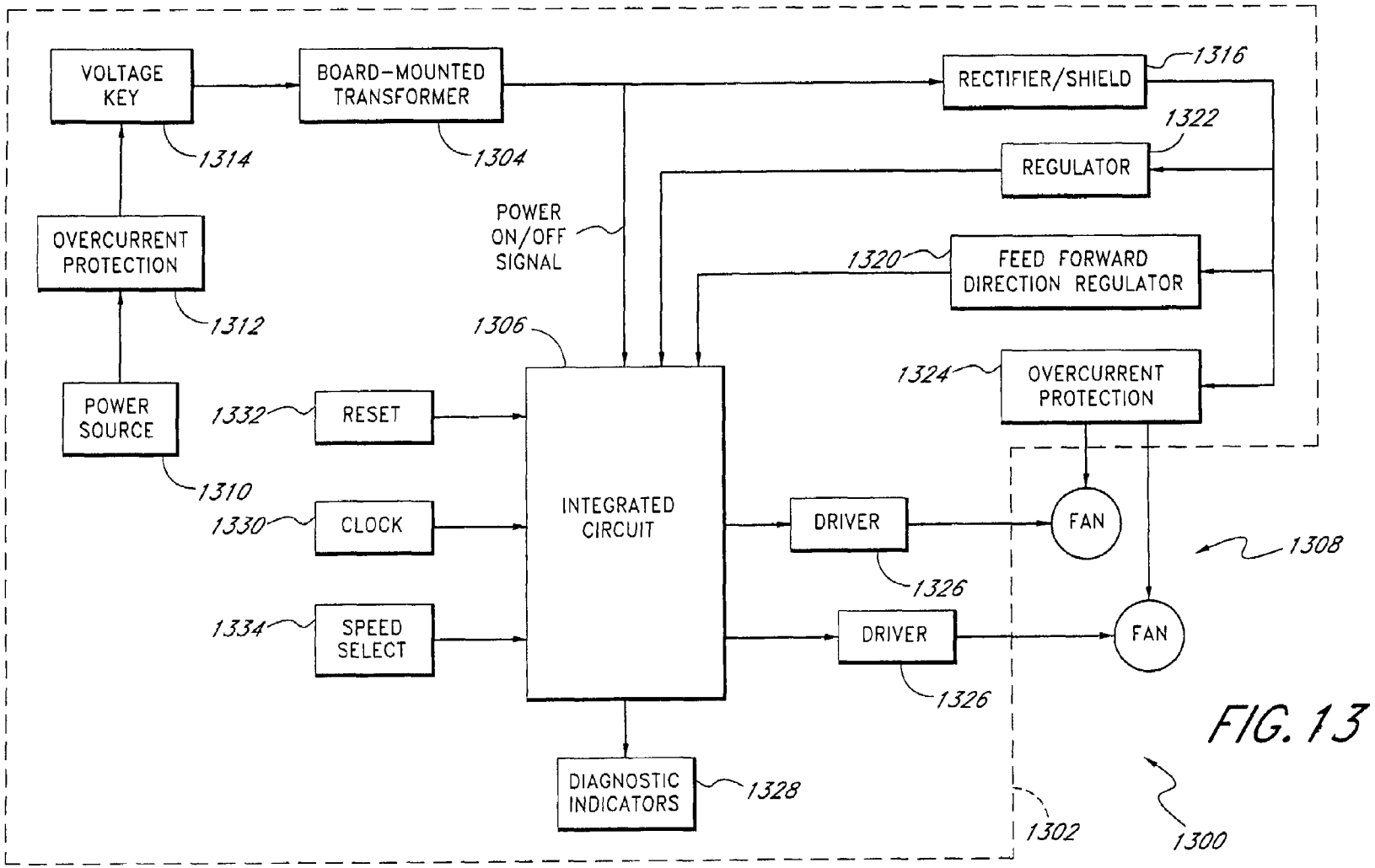
FIG. 13 is a block diagram of a fan controller board that has been arranged and configured in accordance with certain features, aspects and advantages of the present invention.

FIG. 13 is a block diagram of an embodiment of the control circuit 1202 of FIG. 12, where the control circuit 1202 comprises a fan controller board 1300. As shown in FIG. 13, according to one embodiment, the fan controller board 1300 advantageously comprises a printed circuit board (PCB) 1302 having a board mounted transformer 1304 supplying power to an integrated circuit 1306, which in turn provides an output drive signal to one or more fans 1308, as will be described.

As shown in FIG. 13, the board 1300 preferably receives power from the power source 1310. In one arrangement, the power source 1310 may comprise 110 volt or 220 volt AC power, such as that available in commercial and residential buildings. The board 1300 can be protected from abnormal behavior in the power source 1310 by an overcurrent protection 1312. According to one embodiment, the overcurrent protection 1312 comprises normal or self-resetting fuses that interrupt current above the tolerances of the board 1300.

Advantageously, a voltage key 1314 configures the application of power from the power source 1310 to the board mounted step down transformer 1304 to provide isolation and to lower incoming line voltage. For example, the voltage key 1314 preferably configures the wiring through primary windings of the transformer 1304 differently depending upon whether the power source 1310 comprises 110 or 220 volts, as discussed below with reference to FIG. 15. According to one embodiment, the transformer 1304 is of sufficiently light weight that its mounting will not cause the PCB 1302 to deflect, potentially causing open or short circuit conditions because of brittle or broken traces. Moreover, the transformer 1304 includes characteristics voiding the need for special isolation chambers, electromagnetic interference (EMI) shields, or the like. For example, according to one embodiment, the transformer 1304 meets regulations required for devices used in residential buildings, such as, for example, a Class B transformer such as those commercially available from MCI Transformer Corporation of Willits, Calif., or the like. Because a transformer meeting the foregoing recitations is preferred, the transformer 1304 may have tolerance levels near or below that specified for driving the one or more fans 1308 of the personal cooling system of the exercise machine.

In the illustrated arrangement, the output of the transformer 1304 is supplied to the integrated circuit 1306 and a rectifier/EMI shield 1316. The integrated circuit 1306 advantageously comprises one or more of a microprocessor, EEPROM, logic gates, ROM, RAM, flash memory, dedicated controllers, combinations of the same, or the like. The integrated circuit 1306 receives inputs from the user and various components of the board 1300. The integrated circuit 1306 also generates outputs to drive the one or more fans 1308 of the personal cooling system. The integrated circuit 1306 also can activate or change the color of one or more diagnostic indicators or fan speed indicators, as will be discussed with reference to FIGS. 14-16. According to one embodiment, the integrated circuit 1306 comprises a Motorola PIC16C711-04 integrated circuit, which includes control logic and/or program instructions for accepting the inputs and generating the appropriate outputs, as discussed herein.

As shown in FIG. 13, the output of the illustrated transformer 1304 is supplied to the integrated circuit 1306, which uses the output to determine whether power is being continually supplied to the board 1300. Also, the rectifier/EMI shield 1316 converts the low AC voltage from the illustrated transformer 1304 to unregulated DC voltage and provides a shield against EMI.

As shown in FIG. 13, the unregulated DC voltage output from the rectifier/EMI shield 1316 is used to power the one or more fans 1308, as an input to a feed forward direction regulator 1320, and as an input to the DC power regulator 1322, whose output is used to power the illustrated integrated circuit 1306. In one arrangement, the direction regulator 1320 provides a signal to the integrated circuit 1306 indicating whether the unregulated DC voltage is likely to cause the fans 1306 to run backward, fail to start, or the like. In another arrangement, the direction regulator 1320 comprises one or more resistor values providing a predetermined voltage to the integrated circuit 1306 used to determine whether voltage polarity is correct.

As disclosed, the unregulated DC voltage output from the rectifier/EMI shield 1316 also can be used to power the one or more fans 1308. Before powering the fans 1308, the unregulated voltage passes through resetable overcurrent protection 1324. In one arrangement, the protection 1324 includes one or more resetable fuses, such as, for example, one or more polyswitches, which generally protect the circuit from the fans 1308 drawing more current than can be tolerated by the transformer 1304.

In one arrangement, the fans 1308 comprise DC brushless motor fans, such as those commercially available from Delta Electronics. However, AC motor fans, other brush or brushless fans, squirrel cage fans, combinations of the same, or the like can be used to move air to the user.

FIG. 13 also shows the integrated circuit 1306 producing the PWM drive signals, which are forwarded through drivers 1326 to the fans 1308. The drivers 1326 may comprise resistors designed to show voltage levels desired by switching transistors, such as those disclosed with reference to FIG. 12, other switching mechanisms, or the like. The integrated circuit 1306 also outputs a signal or signals to one or more diagnostic indicators 1328. According to one embodiment where the diagnostic indicators 1328 comprises LEDs and multi-colored LEDs, the signal or signals cause the LEDs to energize or change color when certain diagnostic conditions occur. For example, when a user of the exercise machine activates the personal cooling system, the user may select between settings for the speed of the fans 1308. In one embodiment, the diagnostic indicators 1328 may indicate the selected speed. Moreover, the diagnostic indicators 1328 can indicate when the direction regulator 1320 has detected an invalid polarity in the DC voltage, or when one or more of the fans 1308 malfunctions.

The integrated circuit 1306 also accepts a clock input 1330, internal or external resets 1332, and a speed select 1534 indicating a user-selected speed setting of the fans 1308. According to one embodiment, the clock input 1330 comprises a 4 MHz clock signal. The reset 1332 can include a power up internal reset used to reset the integrated circuit 1306 when power is first applied to the board 1300, a manual reset available to the user by, for example, the console 36, the information display arrangements 76, a maintenance switch or button on the PCB 1302 itself, combinations of the same or the like.

The speed select 1334 may advantageously be user selected by, for example, one or more switches, buttons, knobs, touch screen, keyboards, or other input mechanism from the console 36 or information display arrangements 76. For example, the integrated circuit 1306 may receive one or more bits of data indicating the desired speed of the fans of the personal cooling system. For example, one embodiment may include the speed-indicating truth table of Table 1.

TABLE 1

| BIT 1 | BIT 0 | RESULT |
|---|---|---|
| 0 | 0 | OFF |
| 0 | 1 | LOW |
| 1 | 0 | HIGH |
| 1 | 1 | OFF |

FIG. 13 also shows the drivers 1326 and the over current protection 1324 being electrically connected to the fans 1308, which may be remotely located from the PCB 1302. For example, according to one embodiment, the PCB 1302 advantageously installs in the motor housing 28 near a motor controller board (not shown). The PCB 1302 is then connected to, for example, the fans 1308 located in the console 36, a user input mechanism such as the information display arrangements 76, or the like, through, for example, wiring in the standard 34. Such design allows for straightforward maintenance as the controller board 1300 can advantageously be accessed, for example, near the motor control board of the treadmill.

Based on the foregoing disclosure, the fan controller board 1300 advantageously powers the fans 1308 through use of the integrated circuit 1306. Such use provides for future adaptability in that a change to, for example, the fans 1308, may affect only a need for revised software instructions or logic in the microprocessor 1306. Moreover, the voltage key, which allows the control circuit to be powered by varied power supplies, provides ease of adaptability in differing power supply systems.

Figure 14:
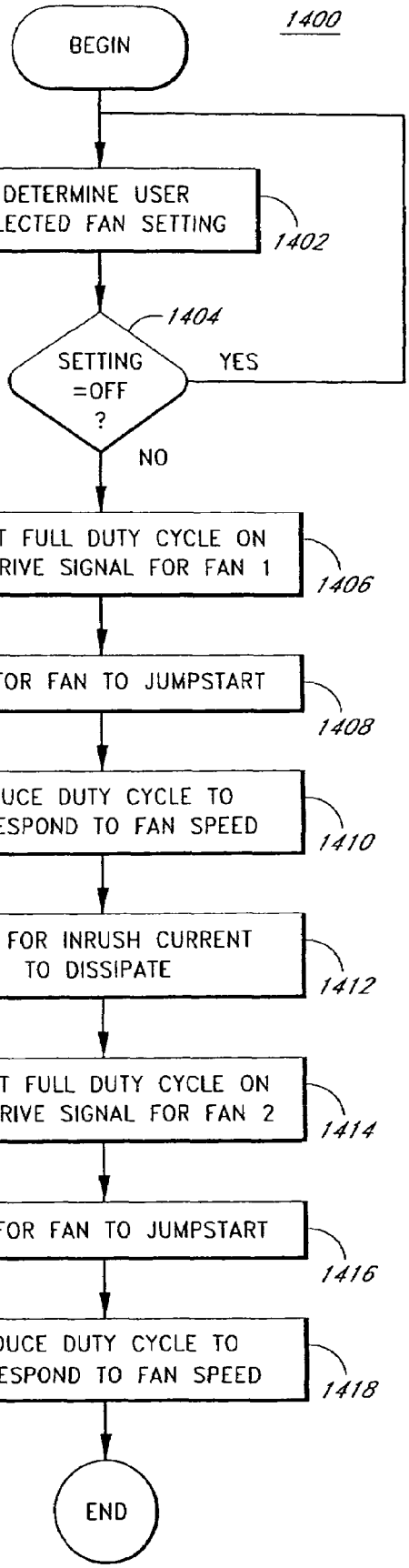
FIG. 14 is a flow chart of a powering on process that is arranged and configured in accordance with certain features, aspects and advantages of the present invention.

FIG. 14 is a flow chart of an exemplary powering on process 1400, used to power on the presently preferred fans 1308 without exceeding the tolerance levels of the presently preferred transformer 1304. As shown in FIG. 14, the process 1400 includes block 1402 where the integrated circuit 1306 determines the user-selected fan setting. As disclosed in the foregoing, the speed may include an actual speed of rotation, an airflow measurement, comparative flow levels like "LOW," "HIGH," "SLOW," "FAST," "FASTER," "FASTEST," combinations of the same, or the like. According to one embodiment, the user selects the setting for his or her personal cooling system as "OFF," "LOW," and "HIGH," from, for example, the console 36 or one of the information display arrangements 76. The integrated circuit 1306 receives the user selection, and at block 1404, the integrated circuit 1306 determines whether the user has selected "LOW" or "HIGH." When the user has selected neither and desires the personal cooling system to be off, the process 1400 returns to block 1402. When the user has select "LOW" or "HIGH," the integrated circuit 1306, at block 1406, outputs the PWM drive signal at full duty cycle to the first of the fans 1308. According to one embodiment, the integrated circuit 1306 may synchronize the PWM drive signal to the AC power from the power source 1310, such as, for example, using a PWM drive signal of 60 or 50 Hz. The integrated circuit 1306 then waits for the fans 1308 to be jumpstarted by the heavy duty cycle. According to one embodiment, the integrated circuit 1306 waits approximately 200 ms, After the jumpstart, the integrated circuit 1306 reduces the duty cycle to correspond with the user selected fan speed. For example, according to one embodiment, a "LOW" speed setting corresponds to around a forty percent (40%) duty cycle, while a "HIGH" speed setting corresponds to around an eighty percent (80%) duty cycle. According to another embodiment, the "LOW" speed setting can range between about 30% and about 50% duty cycle and the "HIGH" speed setting corresponds can range between about 70% and about 90% duty cycle. In addition, the "FULL" duty cycle used to jumpstart the fans can correspond to about a one hundred percent (100%) duty cycle. However, a lower percentage duty cycle can be used to jumpstart the fans. The duty cycle also may vary based on the fan design specifications and manufacturer, may include one, two, or more speed settings, settings for each fan, combinations of the same or the like.

Because the duty cycle of the PWM drive signal is generated by the integrated circuit 1306, the entire board 1300 is advantageously very modular in design. For example, were a design change made to the personal cooling system such that a different fan is used in the system, such as, for example, a squirrel cage fan or a fan by a different manufacturer, an entire redesign of the control circuit is not needed. Rather, a straightforward update to the software and/or logic of the integrated circuit 1306 can accomplish the change, such as, for example, an update associating new duty cycles of the PWM drive signal with the user selected speed settings. In one embodiment, such an update will account for the inrush current of the newly used fans, a desired cooling effect determined by a user or the like.

After reducing the duty cycle, the integrated circuit 1306 at block 1412 waits for the inrush current associated with powering on the first fan to dissipate to a point where another inrush current for jumpstarting another fan, added to the current being used by any already running fans, still does not exceed the tolerances of the transformer 1304. According to one embodiment, the wait takes into account the greatest current draw, for example, the duty cycle of around 80%, and waits approximately 2.5 s, however, the delay can vary to meet any number of operational or other desired parameters. Thereafter, in steps 1414-1418, the integrated circuit 1306 jumpstarts the next fan and reduces its duty cycle to the steady state.

Although the powering on process 1400 is disclosed with reference to its preferred embodiment, the invention is not intended to be limited thereby. Rather, a wide number of alternatives can be used for powering on the fans 1308 without exceeding the tolerances of the board 1300. For example, the integrated circuit 1306 may interleave the powering on the of the fans, power the fans up as soon as there is sufficient current, use delays specifically associated with each user selected speed setting of each fan, combinations of the same. Two such examples illustrating potential steps of exemplary duty cycles being powered on are shown in Table 2.

TABLE 2

| EXAMPLE 1 | | EXAMPLE 2 | |
|---|---|---|---|
| FAN 1 | FAN 2 | FAN 1 | FAN 2 |
| 1 30% | 2 30% | 1 30% | |
| 3 50% | 4 50% | 2 50% | |
| 5 70% | 6 70% | 3 70% | 4 30% |
| 7 80% | 8 80% | 5 80% | 6 50% |
| | | | 7 70% |
| | | | 8 80% |

As disclosed in the foregoing, use of the integrated circuit 1306 advantageously allows for a wide variety of more complex to more straightforward embodiments of powering on the fans 1308, in a way that does not exceed the tolerances of components of the board 1300.

Figure 15:
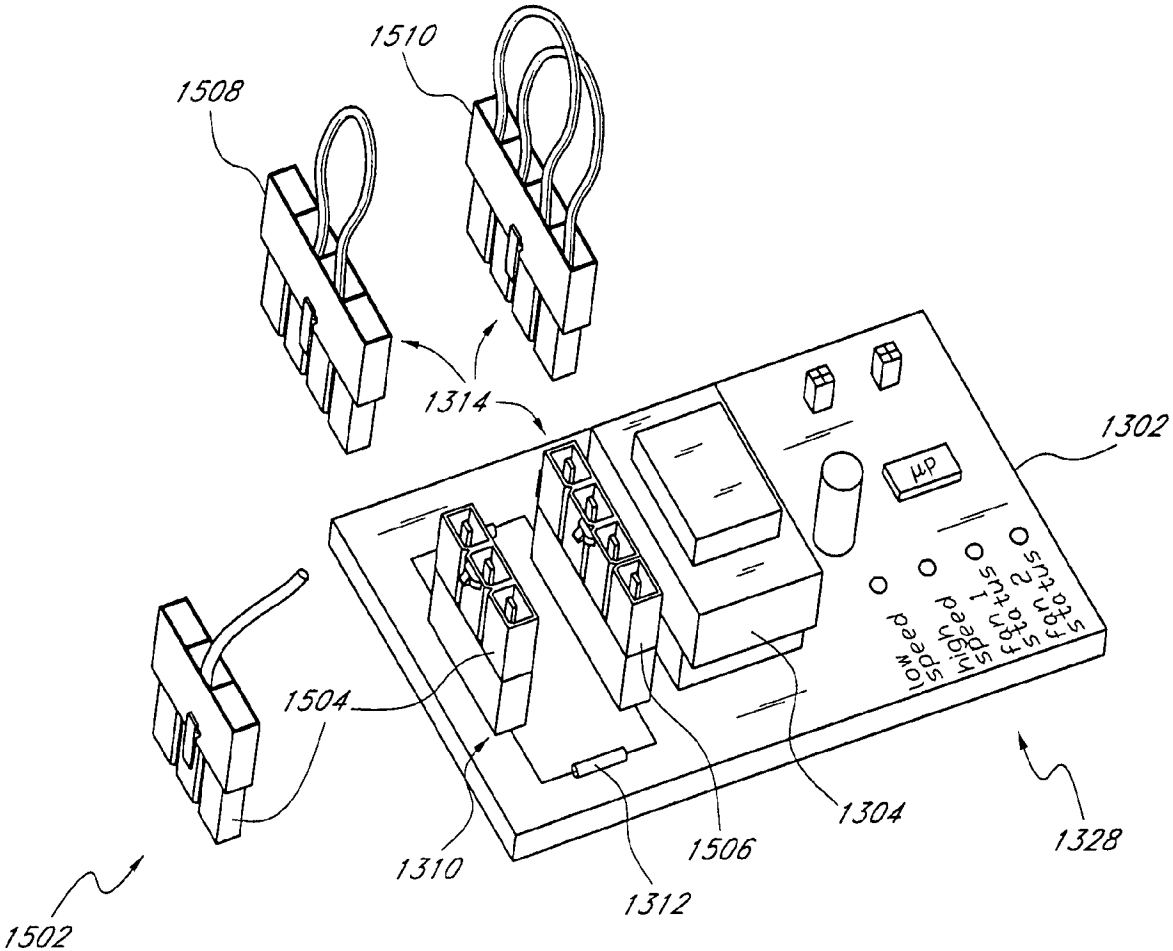
FIG. 15 is a simplified perspective view of the fan controller board of FIG. 13, which is arranged and configured in accordance with certain features, aspects and advantages of the present invention.

FIG. 15 is a simplified perspective view of the fan controller board 1300 of FIG. 13, according to an embodiment of the invention. As shown in FIG. 15, the board 1300 includes the PCB 1302 along with the other components disclosed with reference to FIG. 13. FIG. 15 also highlights the modular design aspects of various embodiments disclosed herein, including components of the power source 1310, components of the voltage key 1314, and the on-board diagnostics indicators 1328. For example, according to one embodiment, the power source 1310 includes a power cable 1502 that connects to the PCB 1302 through mating portions of a connector 1504. The power cable 1502 can connect to one or more other electrical components, such as, for example, a motor controller board. Connection from a motor controller board advantageously allows the power source 1310 to connect to power, such as AC power, which has been filtered to reduce, for example, power spikes, harmonics, or the like. Alternatively, power cable 1502 may connect to traditional residential or industrial power outlets.

FIG. 15 also shows an embodiments of the voltage key 1314 including a receptacle 1506 and two electrically mating plugs 1508 and 1510. As disclosed with reference to FIG. 16, the voltage key 1314 configures the wiring connected to the primary side of the transformer 1304. According to one embodiment, a 220 volt plug 1508 includes about 22 or 12 AWG gauge wire sturdily connected to contact leads within the plug 1508, thereby configuring the transformer 1304 such that the magnetic flux is complementary for the primary windings. Moreover, such configuration provides for ease of maintenance and configurability for users of the exercise machine. For example, the wire is looped such that one or more fingers are easily hooked through the wire to provide a leveraged pull on the plug 1508, thereby removing the plug 1508 from the electrically mating receptacle 1506. According to one embodiment, the plug 1508 includes a releasable hook mechanism which catches on the receptacle 1506 to ensure the plug 1508 remains positioned in electrical contact with the leads of the receptacle 1506.

Similar to plug 1508, a 110 volt plug 1510 includes, according to one embodiment, similar wire of a distinguishing color. The wire is also sturdily connected to contact leads within the plug 1510 and configures the transformer 1304 such that the magnetic flux through at least one portion of the primary windings contradicts the magnetic flux through other portions of the primary windings, thereby causing a load on the secondary windings to receive the same or similar voltage to that when using the 220 volt power source 1310 and the 220 volt plug 1508. Similar to plug 1508, the wire of the plug 1510 is looped such that one or more fingers can hook through the wire and pull the plug 1510 from the electrically mating receptacle 1506.

FIG. 15 also shows the on-board diagnostic indicators 1328. As disclosed in the foregoing, the diagnostic indicators 1328 may comprise LEDs, multi-colored LEDs, LCDs, a combination of the same or the like, representing, for example, the user selected speed setting and one or more fault indicators, such as, for example, improper polarity in the voltage used to drive the fans 1308, or some other fault detected by the integrated circuit 1306. As shown in FIG. 15, one embodiment of the on-board diagnostic indicators 1328 includes an LED for "LOW" and "HIGH" speed settings, and green and red LEDs (i.e., single LEDs with capabilities for showing both green and red) showing the status of the polarity being applied to the fans 1308.

According to one embodiment, the console 36 can include information display arrangements 76 providing feedback to the user of the status of the fans 1308. For example, according to one embodiment, the information display arrangements 76 can include one or more fan speed indicators, such as one or more animated fans or rotating fan blades. For example, when the fan blades are stationary, the fans are "OFF." Alternatively, when the fan blades are rotating the fans are moving. In an embodiment where the user can select between "HIGH," and "LOW," the animated fan blades may rotate at two or more different user-discernable speeds corresponding to the user selected fan setting. These animation rotation speeds advantageously can be much slower than the rotating speed of the fans 1308 to ensure the user can discern the different settings.

Figure 16A:
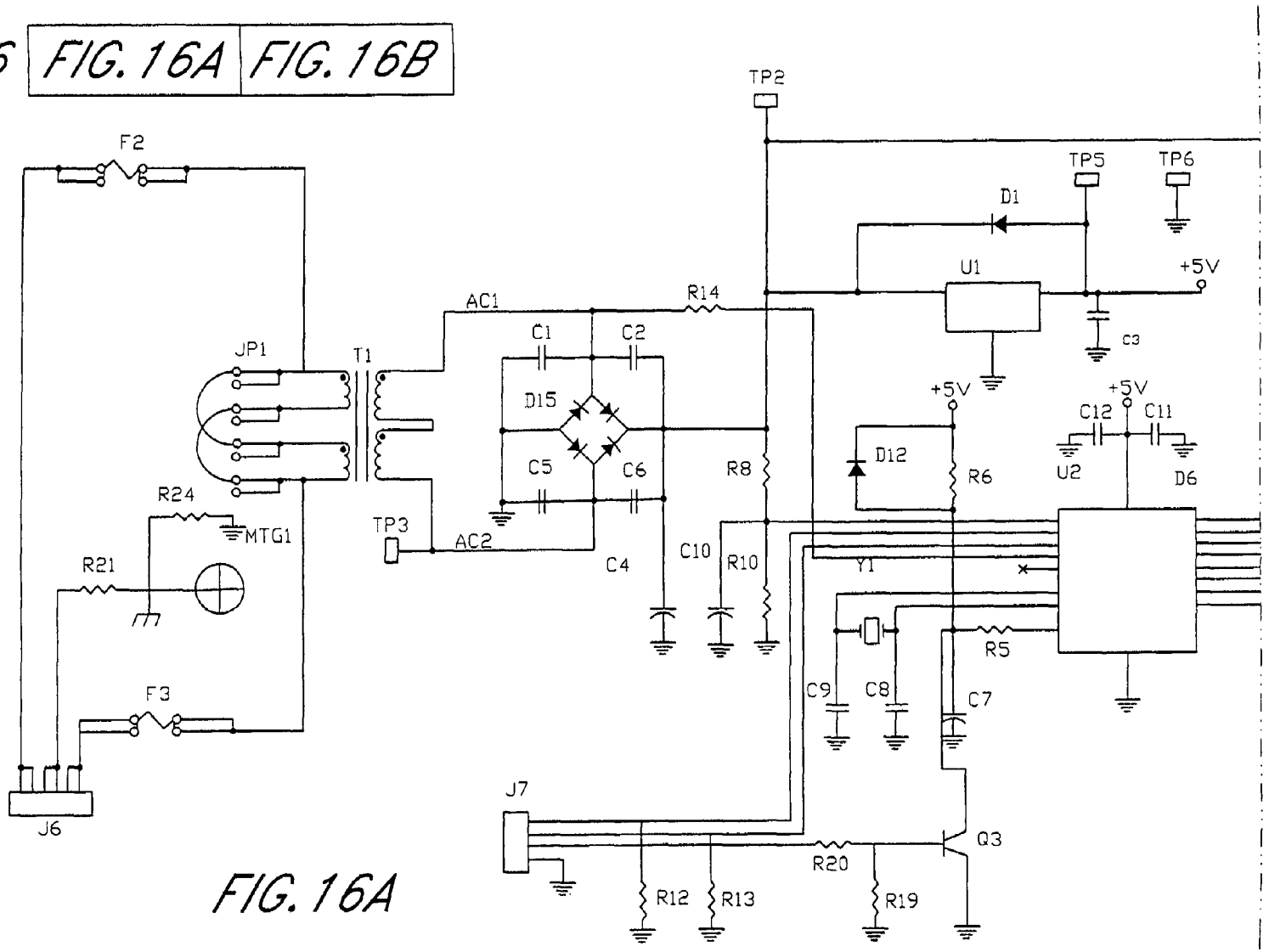
FIG. 16 is a circuit diagram of the fan controller board of FIG. 13, which is arranged and configured in accordance with certain features, aspects and advantages of the present invention.
Figure 16B:
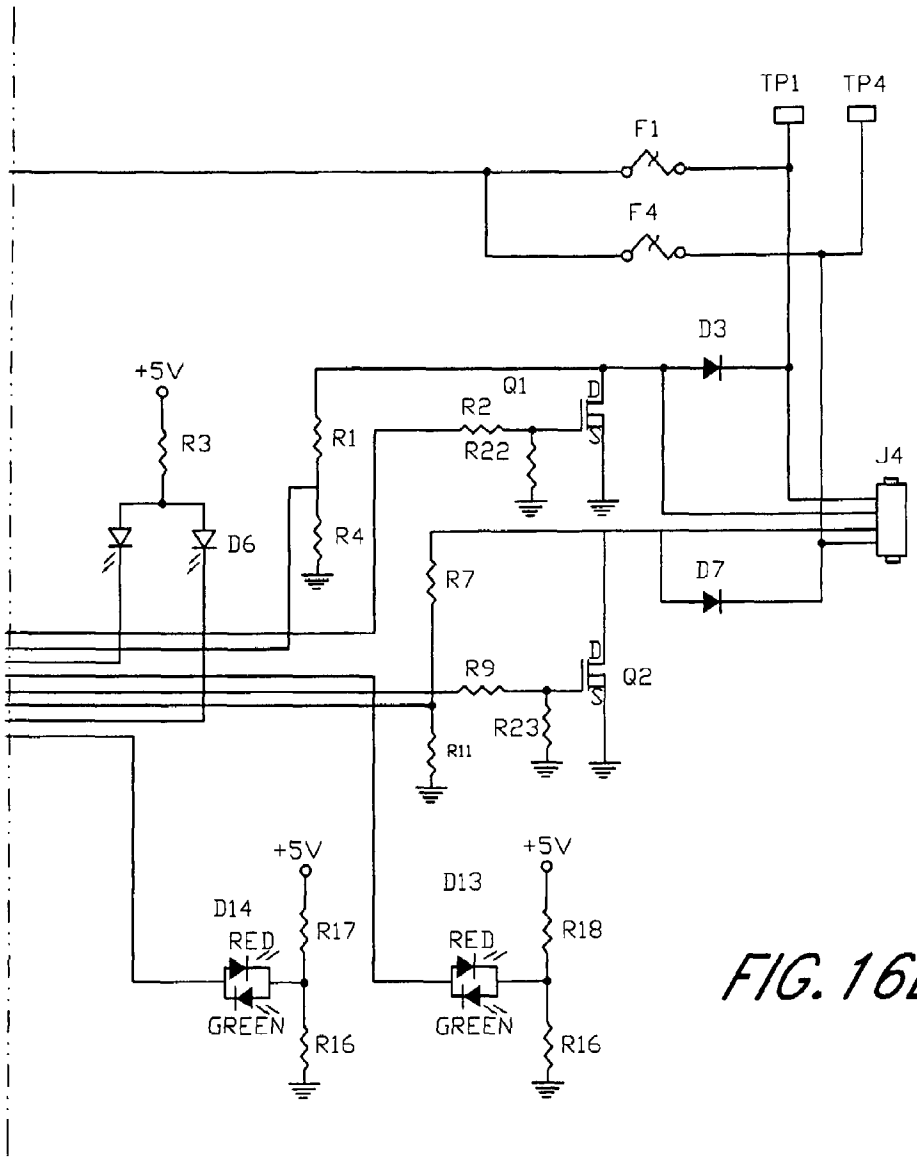

FIG. 16 is one example of a circuit diagram of the fan controller board 1300. The particular values involved with various electronic components in this embodiment are disclosed in Table 3.

TABLE 3

| REFERENCE | PART |
|---|---|
| C1, C2, C5, C6 | 0.01 uF/1 KV |
| C12, C3 | 0.1 uF |
| C4 | 2200 uF/35 V |
| C7 | 1 uF |
| C8, C9 | 22 pF |
| C10 | 100 uF/50 V |
| C11 | 0.01 uF |
| D1 | 1N4003 |
| D3, D7 | 583-FR101 |
| D5, D6 | LED |
| D12 | 1N4148 |
| D13, D14 | 604-L937EGW |
| D15 | 583-BR61 |
| F1, F4 | FT__2A__250 V |
| F2, F3 | 1.25A__SB__250 V |
| JP1 | MOLEX 42019-4212 |
| J4, J7 | MOLEX 43045-0424 |
| J6 | MOLEX 42019-3212 |
| Q1, Q2 | STP30NE06L |
| Q3 | 2N3904 |
| R1, R4, R7, R11, R14 | 12K |
| R2, R3, R9, R15, R16, R17, R18 | 1K |
| R5 | 470 |
| R6 | 39K |
| R8 | 24K |
| R10 | 9.1K |
| R12, R13, R20 | 22K |
| R19, R22, R23 | 100K |
| T1 | MCI-4-44-7010 |
| U1 | LM7805 |
| U2 | PIC16C711__P |
| Y1 | 4.0 MHz |

Although the foregoing invention has been described in terms of certain preferred embodiments, other embodiments will be apparent to those of ordinary skill in the art from the disclosure herein. For example, the foregoing toggled or soft start, or its embodiments, may be employed in virtually any circuit which drives a load that can pull near or more current than is appropriate for circuit components. For example, the soft start can be used to power on a person cooling system employing a large chassis-mounted transformer. Moreover, the fans may be voltage-controlled as opposed to the foregoing control using PWM. Also, the user may adjust the fan speed through buttons, turnable knobs, or the like. Also, AC fans may be used in the personal cooling system.

Figure 17:
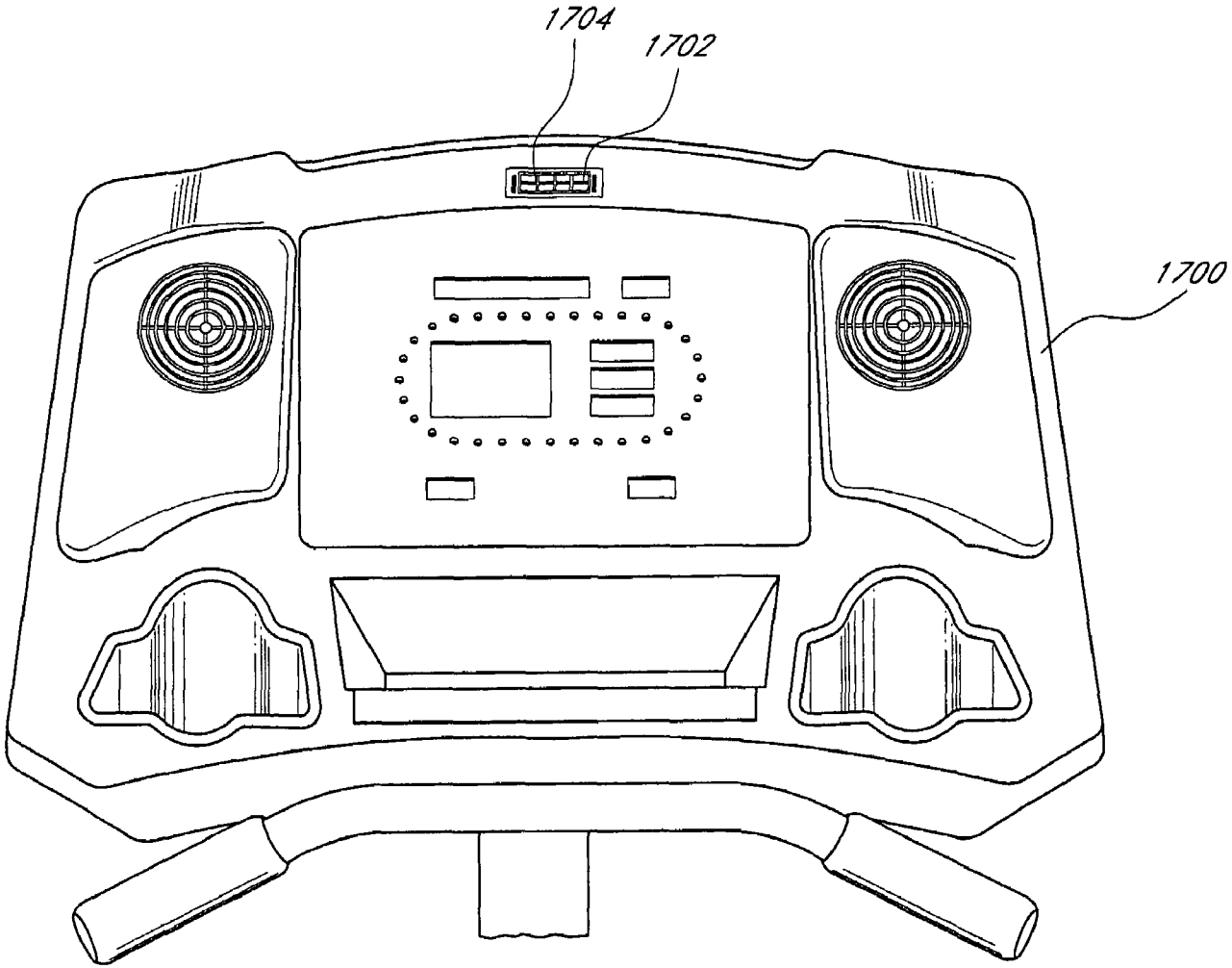
FIG. 17 is a front view of a display console having an adjustable center opening, which is arranged and configured in accordance with certain features, aspects and advantages of the present invention.
Figure 18:
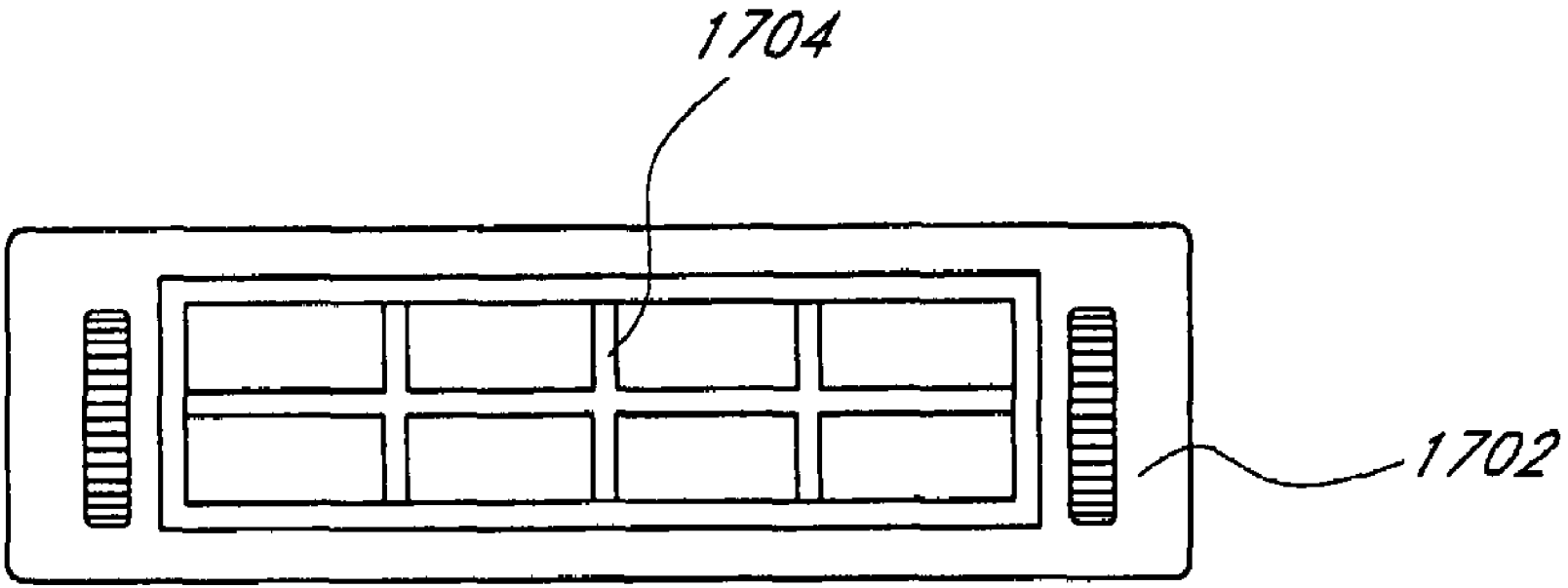
FIG. 18 is a front view of the adjustable center opening of the display console of FIG. 17.

With reference now to FIGS. 17-21, several embodiments of a display console and adjustable openings, such as vents, are arranged and configured in accordance with certain features, aspects and advantages of the present invention. For example, FIGS. 17-18 illustrate a display console 1700 having an adjustable center opening 1702, according to an embodiment of the invention. As shown in FIGS. 17-18, the adjustable center opening can include manual or automatic rotatable grills, louvers, or vents 1704, configured to remain positioned when the user adjusts the openings to his or her particular preference, such as, for example, the user's height. A wide number of alternative configurations can be used for the openings 1702 and the rotatable vents 1704. For example, the display console 1700 can include multiple openings designed to provide direction to air flow, such as, for example, side openings similar to those discussed with reference to FIGS. 1-11, bottom openings, the foregoing top opening 1702, combinations of the same, or the like. Moreover, the rotatable vents 1704 could be vertically or horizontally mounted in the openings, provide for vertical and/or horizontal adjustment, be configured similar to the nozzle or gimbal arrangements disclosed in the foregoing, combinations of the same, or the like.

Figure 19:
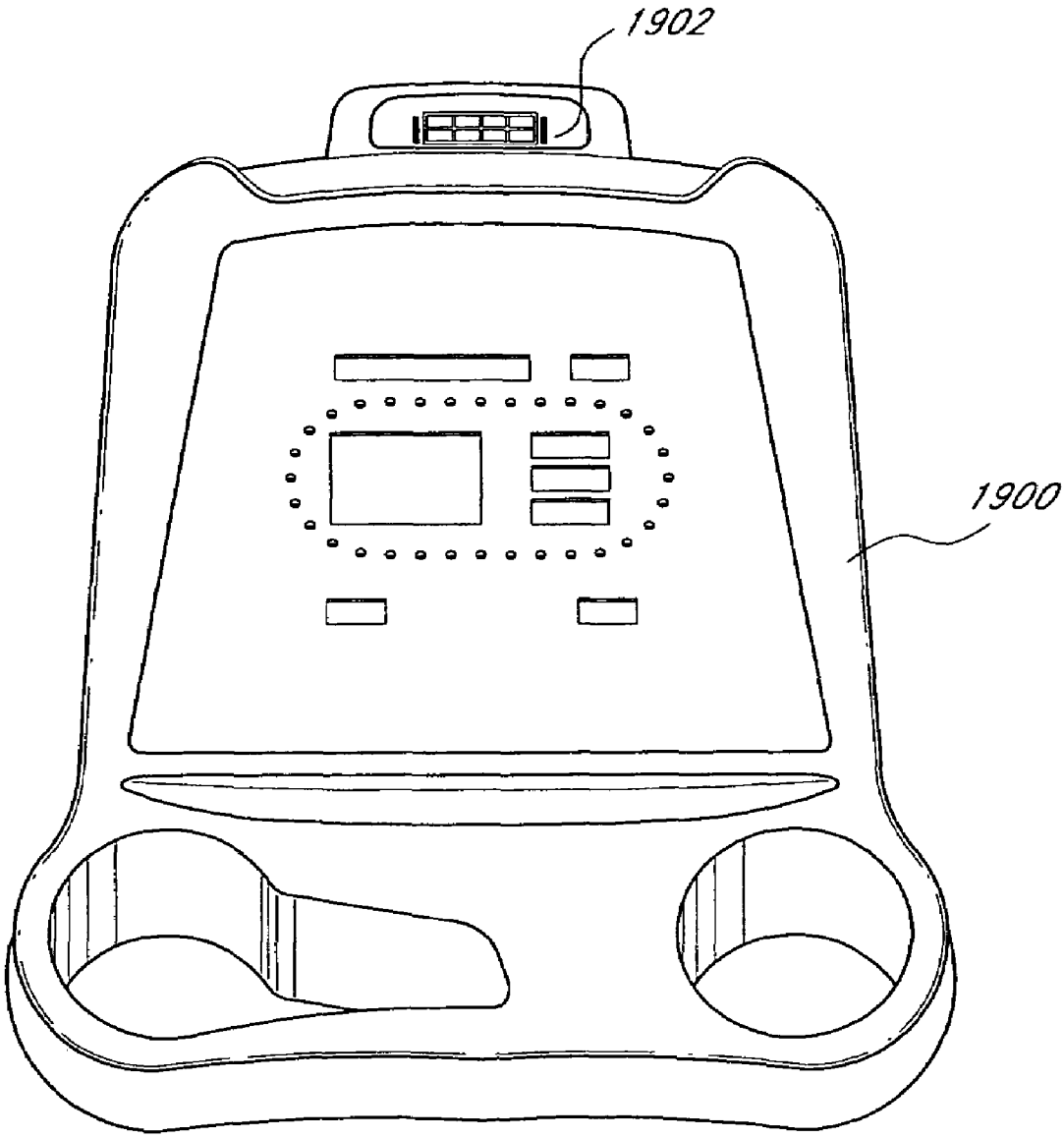
FIG. 19 is a front of a display console having an adjustable center opening, which is arranged and configured in accordance with certain features, aspects and advantages of the present invention.
Figure 20A:
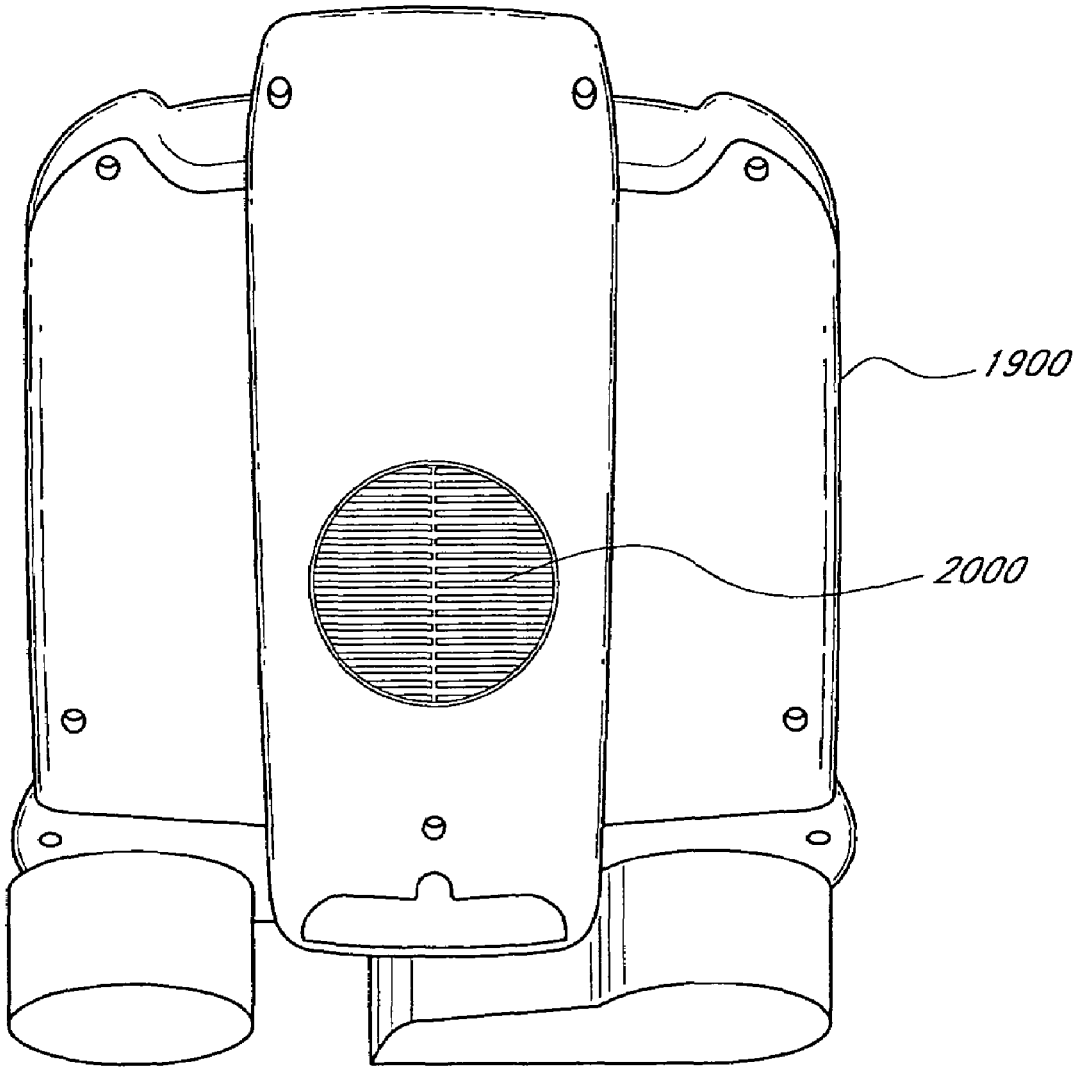
FIG. 20 is a back and side view of the display console of FIG. 19, illustrating embodiments of front and back panels of the display console, as well as air intake and ducting used in a personal cooling system.
Figure 20B:
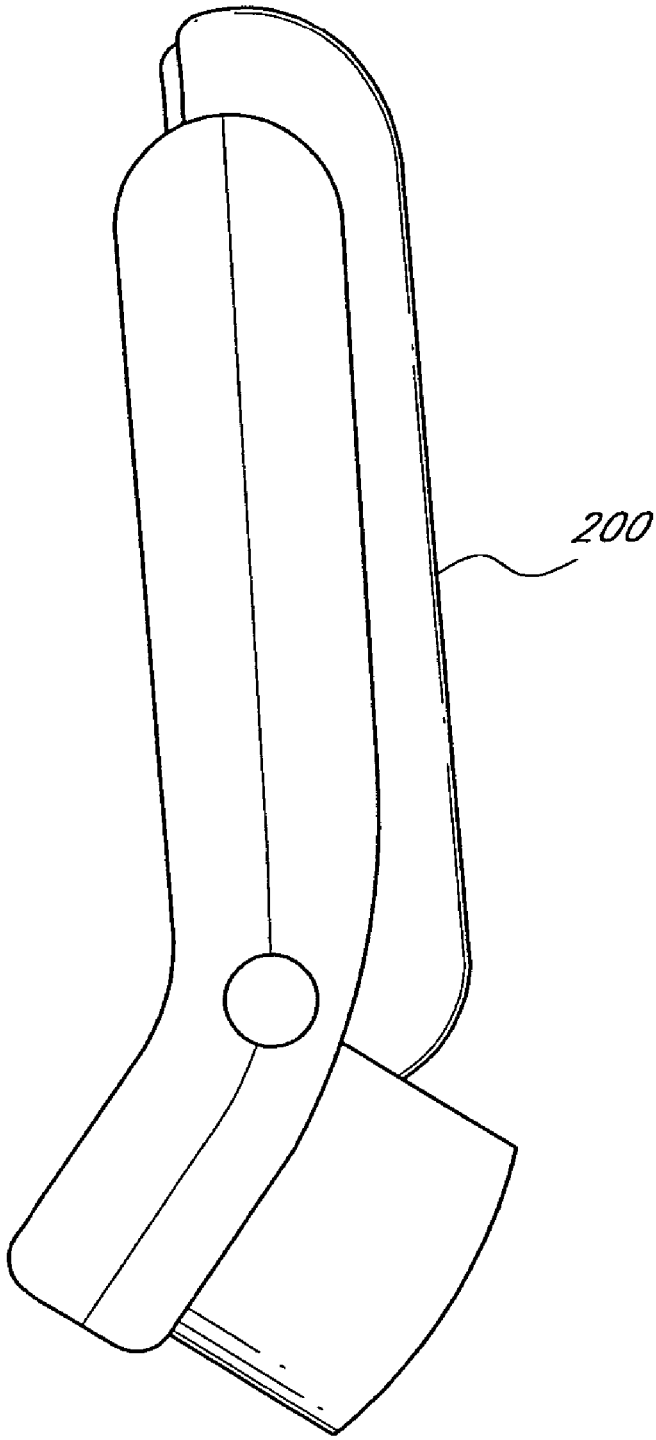

FIGS. 19 and 20 illustrates front, back, and side views of a display console 1900 having an adjustable center opening 1902, according to another embodiment of the invention. As shown, the display console 1900 is formed of a group of suitable plastic moldings, generally comprising front and rear pieces, similar to and for the advantages of, the display console 36 disclosed in the foregoing. FIGS. 20A and 20B also illustrate air intake and ducting 2000 for a personal cooling system similar to those disclosed above.

Figure 21:
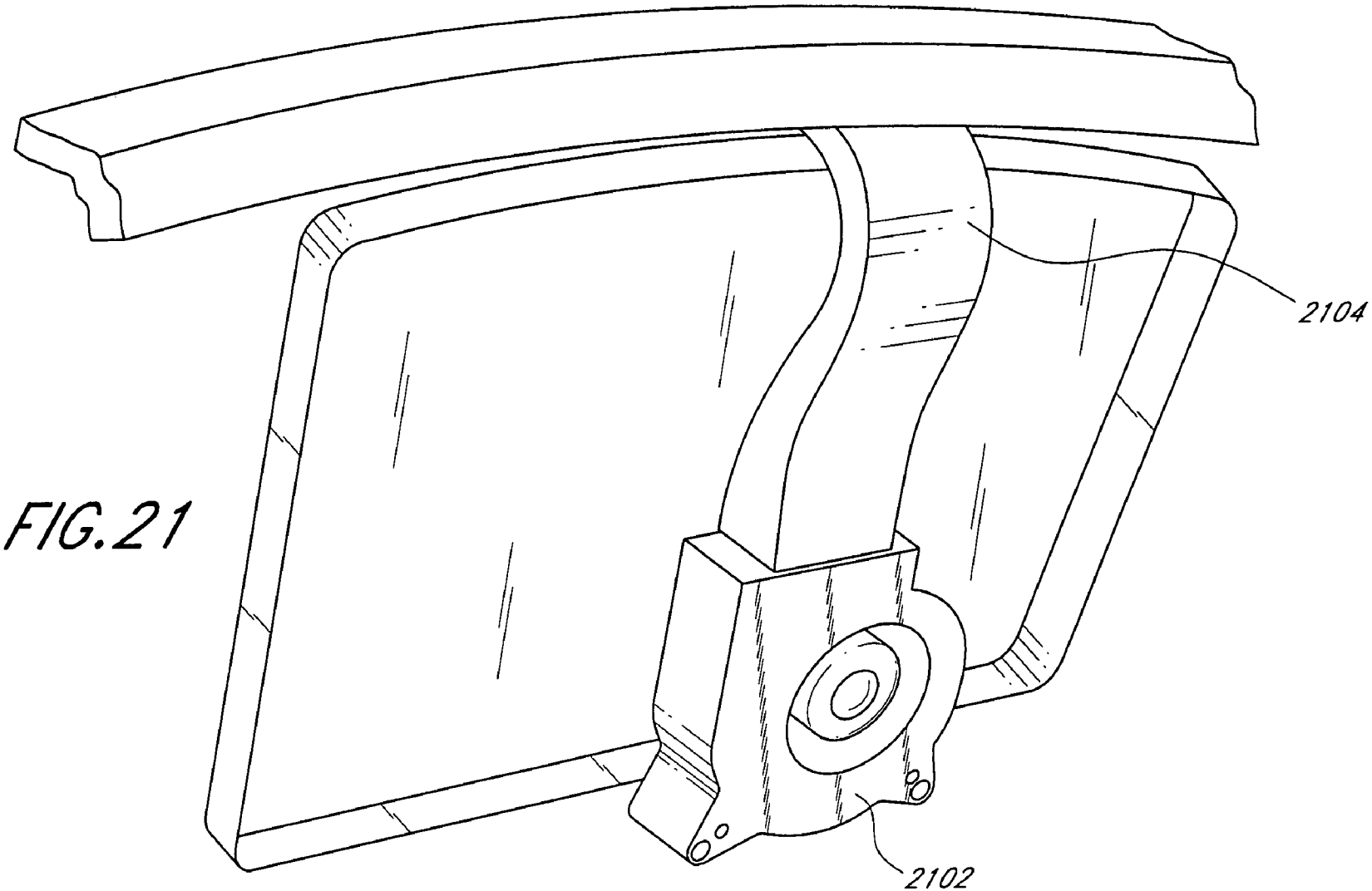
FIG. 21 is a perspective view of the display console of FIG. 19, with the back panel removed to show a squirrel cage fan and ducting for the personal cooling system of FIG. 20.

FIG. 21 is a perspective view of the display console of FIG. 19, with the back panel removed to show a fan assembly 2100, such as, for example, a squirrel cage fan 2102 and ducting 2104 providing air flow for the center opening 1902.

Although the present invention has been described in terms of a certain embodiment, other embodiments apparent to those of ordinary skill in the art also are within the scope of this invention. For instance, a single switch can be used to perform each of the steps of the sequence described above. Thus, various changes and modifications may be made without departing from the spirit and scope of the invention. For instance, various components may be repositioned as desired. Moreover, not all of the features, aspects and advantages are necessarily required to practice the present invention. Additionally, other combinations, omissions, substitutions and modifications will be apparent to the skilled artisan in view of the disclosure herein. Accordingly, the scope of the present invention is intended to be defined only by the claims that follow.

Additionally, all publications, patents, and patent applications mentioned in this specification are herein incorporated by reference to the same extent as if each individual publication, patent, or patent application was specifically and individually indicated to be incorporated by reference.

What is claimed is:

1. A method of activating one or more fans mounted on an exercise machine, the method comprising:

determining a user-selected fan setting for a plurality of fans designed to provide moving air to a user of an exercise machine through one or more openings in the exercise machine, the opening generally positioned around or above a height of an upper torso area of a user; and outputting a drive signal activating the fans based on the user-selected fan-setting, wherein the drive signal accounts for current tolerance levels that can be drawn through a board-mounted transformer, said tolerance levels being near or below current levels needed to jump-start the fans, wherein direct application of current sufficient to simultaneously jumpstart said fans draws currents at a level potentially harmful to one or more components of fan controller circuitry.

2. The method of claim 1, wherein the outputting further comprises outputting a first drive signal to a first of the fans before outputting a second drive signal to a second of the fans.

3. The method of claim 1, further comprising connecting a voltage key to configure the exercise machine to accept a specific power source.

4. The method of claim 3 wherein the connecting said voltage key comprises configuring windings of said board-mounted transformer.

5. The method of claim 1, wherein the user-selected fan setting comprises "OFF."

6. The method of claim 1, wherein the user-selected fan setting comprises "LOW."

7. The method of claim 1, wherein the user-selected fan setting comprises "HIGH."

8. The method of claim 3, wherein the connecting said voltage key comprises inserting into a receptacle one of a plurality of mechanically interchangeable and electrically matable plugs, at least two of said plugs differently configuring said windings of said transformer.

9. The method of claim 8, wherein the inserting said voltage key into said receptacle further comprises inserting said voltage key including wiring exterior to a housing of said plug, said wiring useful in disconnecting said plug from said receptacle.

10. The method of claim 1, wherein a printed circuit board, to which said transformer is mounted, includes a plurality of diagnostic indicators.

11. The method of claim 1, wherein said exercise machine comprises a treadmill.

12. The method of claim 1, wherein said exercise machine comprises a stationary bike.

13. The method of claim 1, wherein said exercise machine comprises an elliptical device.

* * * * *

UNITED STATES PATENT AND TRADEMARK OFFICE

CERTIFICATE OF CORRECTION

PATENT NO. : 7,481,744 B2
APPLICATION NO. : 11/500582
DATED : January 27, 2009
INVENTOR(S) : Reyes et al.

It is certified that error appears in the above-identified patent and that said Letters Patent is hereby corrected as shown below:

On the Title Page (Item 73) under Assignee at line 1, change "Unisen, Inc.," to --Unisen, Inc., dba Star Trac--.

In column 12 at line 44 (Approx.), change "same." to --same, or the like.--.

In column 16 at line 22 in Claim 4, after "3" insert --,--.

Signed and Sealed this

Thirtieth Day of June, 2009

JOHN DOLL
*Acting Director of the United States Patent and Trademark Office*